US006656887B2

(12) United States Patent
Yagishita et al.

(10) Patent No.: US 6,656,887 B2
(45) Date of Patent: Dec. 2, 2003

(54) LUBRICATING OIL COMPOSITIONS

(75) Inventors: Kazuhiro Yagishita, Yokohama (JP); Jinichi Igarashi, Yokohama (JP); Takeo Koizumi, Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 10/055,600

(22) Filed: Jan. 23, 2002

(65) Prior Publication Data

US 2002/0142922 A1 Oct. 3, 2002

(30) Foreign Application Priority Data

Jan. 24, 2001 (JP) ..... 2001-016418

(51) Int. Cl.[7] ..... C10M 137/06; C10M 137/08

(52) U.S. Cl. ..... 508/371; 508/372; 508/377; 508/378; 508/435

(58) Field of Search ..... 508/377, 435, 508/371

(56) References Cited

U.S. PATENT DOCUMENTS

| | | | | |
|---|---|---|---|---|
| 4,179,384 A | * | 12/1979 | Mann | 508/377 |
| 4,529,526 A | * | 7/1985 | Inoue et al. | 508/377 |
| 4,925,596 A | * | 5/1990 | Maeda et al. | 508/377 |
| 5,093,016 A | * | 3/1992 | Colombo | 508/377 |
| 5,352,374 A | * | 10/1994 | Habeeb et al. | 508/435 |
| 5,415,793 A | * | 5/1995 | Nassry et al. | 508/377 |
| 6,187,723 B1 | * | 2/2001 | Holt et al. | 508/377 |

FOREIGN PATENT DOCUMENTS

JP 06-041568 2/1994

OTHER PUBLICATIONS

Smalheer et al, "Lubricant Additives", pp. 1–11, 1967.*

* cited by examiner

*Primary Examiner*—Ellen M. McAvoy
(74) *Attorney, Agent, or Firm*—Akin Gump Strauss Hauer & Feld, L.L.C.

(57) ABSTRACT

Lubricating oil compositions comprise a lubricating base oil and (A) at least one compound selected from the group consisting of compounds represented by formula (1) below and compounds represented by formula (2) below:

(1)

wherein $R^2$, $R^1$, $R^3$ and $R^4$ are each independently hydrogen or a hydrocarbon group having 1 to 30 carbon atoms, $X^1$, $X^2$, $X^3$ and $X^4$ are each independently oxygen or sulfur, but at least one of them is oxygen, and $Y^1$ is a metal atom; and (2)

wherein $R^{11}$ and $R^{12}$ are each independently hydrogen or a hydrocarbon group having 1 to 30 carbon atoms, $X^{11}$ and $X^{12}$are each independently oxygen or sulfur, but at least one of them is oxygen, U is a monovalent metal ion, an ammonium ion or a proton, and $k^1$ is an integer of 1 to 20. Lubricating oil compositions have excellent anti-wear properties and base number maintaining properties.

18 Claims, 4 Drawing Sheets

The change of total base number against time measured in accordance with ISOT

The change of total base number against time measured in accordance with ISOT

The change of total base number against time measured in accordance with ISOT

The change of total base number against time measured in accordance with NOx absorbing test The change of total base number against time measured in accordance with NOx absorbing test The change of total base number against time measured in accordance with NOx absorbing test The change of total base number against time measured in accordance with the 1GFE high-temperature oxidation test of JASO (Comparison between Inventive Example 11 and Comparative Example 3)

The change of total acid number against time measured in accordance with the 1GFE high-temperature oxidation test of JASO (Comparison between Inventive Example 11 and Comparative Example 3)

The change of kinematic viscosity increase rate at 40°C against time in accordance with the 1GFE high-temperature oxidation test of JASO

LUBRICATING OIL COMPOSITIONS

BACKGROUND OF THE INVENTION

1. Field of the Invention

This invention relates to lubricating oil compositions, and more particularly to lubricating oil compositions which contain the metal salt or amine salt of thiophosphate or of phosphate and are decreased in sulfur content and excellent in the ability to maintain the total base number of lubricating oil composition.

2. Description of the Prior Art

Zinc dialkyldithiophosphate (ZDTP) has excellent anti-wear and anti-oxidation properties and thus has been used as an essential additive in lubricating oils for such as internal combustion engines or hydraulic oils and in every sort of lubricating oils.

On the other hand, sulfur-based additives such as zinc dialkyldithiocarbamate(ZDTC) or others are used in lubricating oil to keep anti-wear property instead of ZDTP_as disclosed in Japanese Patent Laid-Open Publication Nos. 52-704, 62-253691, 63-304095, and 6-41568 and Published Japanese Translation Nos. 62-501572, 62-501917, and 1-500912. The lubricating oils disclosed in these publications contain a large quantity of sulfur similarly to those containing ZDTP. Such lubricating oils are poor in oxidation stability and tend to be acceleratingly decreased in total base number of the composition.

After an extensive research and study on the ability to maintain the base number of lubricating oils containing a large amount of sulfur in the process of the degradation, it was found that the oxidation or thermal decomposition of a compound containing sulfur-based additives, such as ZDTP results in the formation of sulfuric acid which significantly decreases the total base number of the composition and deteriorates the high-temperature detergency at a temperature exceeding 300° C. It was also found that when recent low-sulfurized gasolines and gas oils, or alternative fuels such as LPG and natural gas are used as fuel particularly in an internal combustion engine, the decomposition of the sulfur-based additive such as ZDTP itself significantly affects the total base number maintaining properties and high-temperature detergency of the lubricating oil. Therefore, it becomes necessary to optimize the wear inhibitor such as ZDTP so as to obtain a longer drain-interval oil than conventional oils while keeping the anti-wear properties thereof. Furthermore, organic molybdenum compounds such as molybdenum dithiocarbamate and molybdenum dithiophosphate are found to be most effective in order to impart fuel efficiency and thus have been used. However, since these compounds contain a large amount of sulfur, they can not improve the total base number maintaining properties and high-temperature detergency and thus fail to obtain both long drain properties and fuel efficiency.

The object of the present invention is to provide a lubricating oil composition which can maintain or enhance anti-wear properties even though decreased in the amount of conventional ZDTP or containing no ZDTP at all and which has excellent long drain properties by suppressing the decrease of the total base number resulting from the deterioration of the lubricating oil. Another object of the present invention is to provide a lubricating oil composition with high-temperature detergency and fuel efficiency and low sulfur content.

After an extensive research and study made so as to solve the foregoing problems, the present invention was achieved by finding that the use of specific phosphorus-containing compounds represented by formulae (1) and/or (2) described hereinafter can produce a lubricating oil composition which can suppress the decrease of the base number resulting from the deterioration of the lubricating oil while maintaining anti-wear properties which are substantially equivalent to or better than those of ZDTP and are excellent in high-temperature detergency and fuel efficiency.

BRIEF SUMMARY OF THE INVENTION

According to the present invention, there is provided a lubricating oil composition which comprises a lubricating base oil and (A) at least one compound selected from the group consisting of compounds represented by the formula

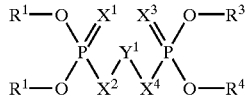

(1)

wherein $R^1$, $R^2$, $R^3$ and $R^4$ are each independently hydrogen or a hydrocarbon group having 1 to 30 carbon atoms, $X^1$, $X^2$, $X^3$ and $X^4$ are each independently oxygen or sulfur, but at least one of them is oxygen, and $Y^1$ is a metal atom; and compounds represented by the formula

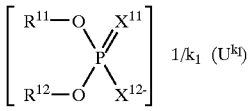

(2)

wherein $R^{11}$ and $R^{12}$ are each independently hydrogen or a hydrocarbon group having 1 to 30 carbon atoms, $X^{11}$ and $X^{12}$ are each independently oxygen or sulfur, but at least one of them is oxygen, U is a monovalent metal ion, an ammonium ion or a proton, and $k^1$ is an integer of 1 to 20.

DETAILED DESCRIPTION OF THE INVENTION

Figure 1:
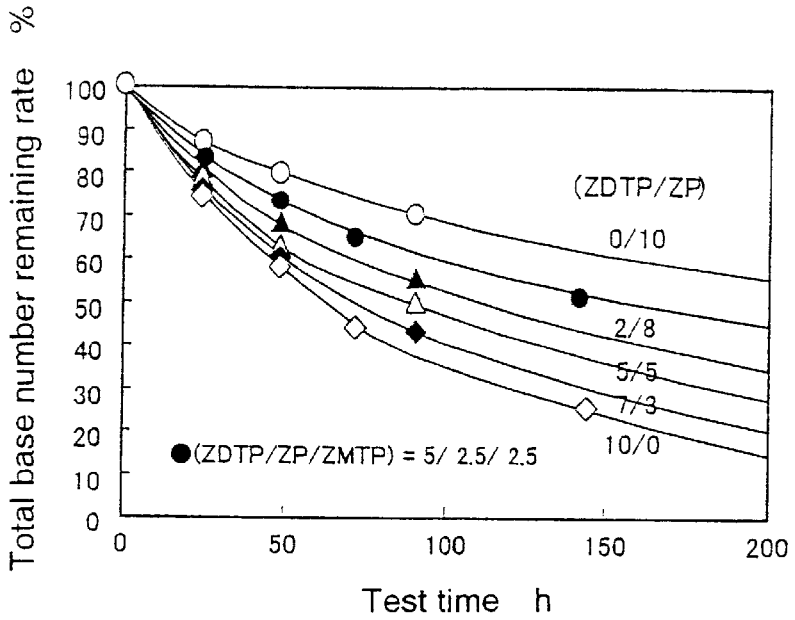
FIG. 1 is a graphical plot of the change of total base number against time of the lubricating oil compositions of Inventive Examples 1 to 5 and Comparative Example 1 measured in accordance with ISOT.

The lubricating oil composition of the present invention comprises a lubricating base oil and Component (A) which is a compound represented by formula (1) and/or (2).

No particular limitation is imposed on the lubricating base oil which, therefore, may be any base oil which can be used in ordinary lubricating oils. No particular limitation is imposed on the kinematic viscosity of the base oil, either. However, the upper limit at 100° C. is preferably 50 $mm^2/s$, and more preferably 40 $mm^2/s$. When the lubricating oil composition is used in an internal combustion engine, the upper limit is preferably 20 $mm^2/s$, and more preferably 10 $mm^2/s$. The lower limit is preferably 1 $mm^2/s$, and more preferably 2 $mm^2/s$. A base oil in excess of the upper limit of kinematic viscosity at 100° C. results in a lubricating oil composition which is deteriorated in low-temperature viscosity properties, while a base oil of less than the lower limit results in a lubricating oil composition which is insufficient in the film formation ability at parts to be lubricated and increased in evaporation loss.

No particular limitation is imposed on the viscosity index of the lubricating base oil. However, it is preferably 80 or more. If the viscosity index is less than 80, the resulting oil composition is deteriorated in low-temperature viscosity properties. The viscosity index of the base oil is preferably 100 or greater, more preferably 110 or greater, and particularly preferably 120 or greater so that excellent viscosity properties can be obtained, ranging from lower temperatures to higher temperatures. This is particularly important when the oil is used for an internal combustion engine.

No particular limitation is imposed on the sulfur content in the lubricating oil composition. However, the sulfur content is preferably 0.1 percent by mass or less, more preferably 0.01 percent by mass or less, and particularly preferably 0.005 percent by mass or less or substantially no sulfur (0.001 percent by mass or less).

No particular limitation is imposed on the upper limit total aromatic content of the base oil. However, the upper limit is preferably 30 percent by mass, more preferably 15 percent by mass, further more preferably 5 percent by mass, and particularly preferably 2 percent by mass. If the total aromatic content of the base oil is in excess of the upper limit, the resulting lubricating oil composition is poor in oxidation stability.

The term "total aromatic content" denotes an aromatic fraction content measured in accordance with ASTM D2549. The aromatic fraction includes anthracene, phenanthracene, and alkylated products thereof, compounds wherein four or more benzene rings are condensated to each other, and compounds having heteroaromatics such as pyridines, quinolines, phenols and naphthols other than alkylbenzenes and alkylnaphthalenes.

Eligible lubricating base oils are mineral lubricating oils, synthetic lubricating oils or mixtures of two or more of the mineral and synthetic lubricating oils, mixed in an arbitrary ratio.

For example, the mixture may be a mixture of one or more mineral oils, a mixture of one or more synthetic oils, and a mixture of one or more mineral oils and one or more synthetic oils.

Specific examples of the mineral lubricating oil are those which are produced by subjecting lubricant fractions resulting from the atmospheric distillation and the vacuum distillation of crude oil to one or more refining processes such as solvent deasphalting, solvent extraction, hydrocracking, solvent dewaxing, and hydrorefining in suitable combination.

Specific examples of the synthetic oil are polybutens and hydrides thereof; poly-α-olefins such as 1-octene oligomer and 1-decene oligomer and hydrides thereof; diesters such as ditridecyl glutarate, di-2-ethylhexyl adipate, diisodecyl adipate, ditridecyl adipate, and di-2-ethylhexyl sebacate; polyol esters such as trimethylolpropane caprylate, trimethylolpropane pelargonate, pentaerythritol-2-ethyl hexanoate, and pentaerythritol pelargonate; and aromatic synthetic oils such as alkylnaphthalenes and alkylbenzenes.

Component (A) is now described.

Component (A) may be a compound of formula (1) below, i.e., the metal salt of thiophosphate or phosphate

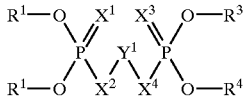

(1)

In formula (1), $R^1$, $R^2$, $R^3$ and $R^4$ are each independently hydrogen or a hydrocarbon group having 1 to 30 carbon atoms. $X^1$, $X^2$, $X^3$ and $X^4$ are each independently oxygen or sulfur but at least one of them is oxygen. $Y^1$ is a metal atom.

Examples of the hydrocarbon group of $R^1$, $R^2$, $R^3$ and $R^4$ are straight-chain or branched alkyl groups, cyclic alkyl groups which may have substituents, straight-chain or branched alkenyl groups, unsubstituted or alkyl-substituted aryl groups, and arylalkyl groups.

Specific examples of the straight-chain or branched alkyl groups are methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups.

Specific examples of the cyclic alkyl groups which may have substituents are cycloalkyl groups having 5 to 7 carbon atoms such as cyclopentyl, cyclohexyl and cycloheptyl groups, and alkylcycloalkyl groups having 6 to 11 carbon atoms wherein the position of the alkyl group may vary, such as metylcyclopenthyl, dimetylcyclopenthyl, methylethylcyclopentyl, dimethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups.

Specific examples of the straight-chain or branched alkenyl groups are those having 2 to 30 carbon atoms wherein the position of the double bond may vary, such as butenyl, pentenyl, hexcenyl, hepteneyl, octenyl, nonenyl, decenyl, undecenyl, dodecenyl, tridecenyl, tetradecenyl, pentadecenyl, hexadecenyl, heptadecenyl, and octadecenyl group.

Specific examples of the unsubstituted or alkyl-substituted aryl groups are aryl groups having 6 to 18 carbon atoms such as phenyl and naphtyl groups, and alkylaryl groups having 7 to 26 carbon atoms wherein the alkyl group may be straight-chain or branched and may bonded to any position of the aryl group, such as tolyl, xylyl, ethylphenyl, propylphenyl, butylphenyl, pentylphenyl, hexylphenyl, heptylphenyl, octylphenyl, nonylphneyl, decylphenyl, undecylphenyl, dodecylphenyl, diethylphenyl, dibutylphenyl and dioctylphenyl groups.

Specific examples of the arylalkyl groups are those having 7 to 12 carbon atoms wherein the alkyl group may be straight-chain or branched, such as benzyl, phenylethyl, phenylpropyl, phenylbutyl, phenylpentyl and phenylhexyl groups.

Among the above-exemplified hydrocarbon groups, particularly preferred are straight-chain or branched alkyl groups having 3 to 18 carbon atoms and aryl and straight-chain or branched alkylaryl groups having 6 to 18 carbon atoms.

$X^1$, $X^2$, $X^3$ and $X^4$ are each independently oxygen or sulfur but at least one of them is oxygen. Preferably two or more of them are oxygen, and more preferably all of them are oxygen. Due to the presence of at least one oxygen, the resulting composition is less in sulfur content and in the amount of sulfur produced when being oxidized or thermally decomposed, than the case where no oxygen is present, i.e. all of $X^1$, $X^2$, $X^3$ and $X^4$ are sulfur, such as ZDTP.

Specific examples of the metal atoms of $Y^1$ are zinc, copper, iron, lead, nickel, silver, manganese, calcium, magnesium, and barium. $Y^1$ is preferably zinc or calcium because more improved base number maintaining properties, high-temperature detergency and anti-wear properties can be obtained.

Component (A) may also be a compound of formula (2) below, i.e., thiophosphate, phosphate or the metal or amine salt thereof:

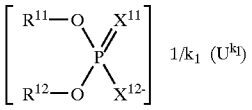

(2)

In formula (2), $R^{11}$ and $R^{12}$ are each independently hydrogen or a hydrocarbon group having 1 to 30 carbon atoms. $X^{11}$ and $X^{12}$ are each independently oxygen or sulfur, but at least one of them is oxygen. U is a monovalent metal ion, an ammonium ion or a proton. $k^1$ is an integer of 1 to 20, preferably 1 to 10 and more preferably 1 to 8.

The hydrocarbon groups of $R^{11}$ and $R^{12}$ are the same as those as defined with respect to $R^1$, $R^2$, $R^3$, and $R^4$ in formula (1). Preferred examples of the hydrocarbon groups are also the same as those exemplified with respect to $R^1$, $R^2$, $R^3$, and $R^4$ in formula (1). $X^{11}$ and $X^{12}$ are each independently oxygen or sulfur but at least one of them is oxygen. The monovalent metal ion of $U^1$ is a metal atom which can form a salt and thus may be an alkali metal, such as lithium, sodium, potassium and cesium. It also may be hydrogen (proton). The ammonium ion may be those derived from nitrogen-containing compounds which can form an amine salt.

The nitrogen-containing compound may be ammonia, monoamines, diamines, and polyamines. Specific examples are alkylamines having 1 to 30 carbon atoms wherein the alkyl group may be straight-chain or branched, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having 2 to 30 carbon atoms wherein the alkenyl group may be straight-chain or branched, such as ethenylamine, propenylamine, butenylamine, octenylamine and oleylamine; alkanolamines wherein the alkanol group may be straight-chain or branched and has 1 to 30 carbon atoms such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamines having 1 to 30 carbon atoms such as methylenediamine, ethylenediamine, propylenediamine, and butylenediamine; polyamines such as diethylenetrimaine, triethylenetetramine, tetraethylenepentamine, and pentaethylenehexamine; heterocyclic compounds such as those having alkyl or alkenyl groups having 8 to 20 carbon atoms bonded to the above-exemplified monoamines, diamines and polyamines such as undecyldiethylamine, undecyldiethanolamine, dodecyldipropanolamine, oleyldiethanolamine, oleylpropylenediamine, stearyltetraethylenepentamine and N-hydroxyethyloleylimidazoline; alkylene adducts thereof; and mixtures thereof.

Component (A) is preferably a compound of formula (1) wherein 1 to 3, preferably 2 or 3 of $X^1$, $X^2$, $X^3$, and $X^4$ are oxygen or a compound of formula (1) wherein all of $X^1$, $X^2$, $X^3$ and $X^4$ are oxygen.

Specific examples of the compound of formula (1) wherein 1 to 3 of $X^1$, $X^2$, $X^3$, and $X^4$ are oxygen are zinc dialkylthiophosphates wherein the alkyl group may be straight-chain or branched and has 3 to 18 carbon atoms, such as zinc dipropylthiophosphate, zinc dibutylthiophosphate, zinc dipentylthiophosphate, zinc dihexylthiophosphate, zinc diheptylthiophosphate, and zinc dioctylthiophosphate; and zinc di((alkyl)aryl)thiophosphate wherein the aryl or alkylaryl group has 6 to 18 carbon atoms, such as zinc diphenylthiophosphate, and zinc ditolylthiophosphate.

Specific examples of the compound of formula (1) wherein all of $X^1$, $X^2$, $X^3$, and $X^4$ are oxygen are zinc dialkylphosphate wherein the alkyl group may be straight-chain or branched and has 3 to 18 carbon atoms, such as zinc dipropylphosphate, zinc dibutylphosphate, zinc dipentylphosphate, zinc dihexylphosphate, zinc diheptylphosphate, and zinc dioctylphosphate; and zinc di((alkyl)aryl)phosphate wherein the aryl or alkylaryl group has 6 to 18 carbon atoms, such as zinc diphenylphosphate and zinc ditolylphosphate.

Other than the above-described zinc salts, preferred are the metal salts such as copper, iron, lead, nickel, silver, manganese, calcium, magnesium, and barium salts.

Compounds of formula (2) for Component (A) are preferably the amine salts of thiophosphates or phosphates. Specific examples are the salts of dialkylthiophosphates wherein the alkyl group may be straight-chain or branched and has 3 to 18 carbon atoms, such as dipropylthiophosphate, dibutylthiophosphate, dipentylthiophosphate, dihexylthiophosphate, diheptylthiophosphate and dioctylthiophosphate; dialkylphosphates wherein the alkyl group may be straight-chain or branched and has 3 to 18 carbon atoms, such as dipropylphosphate, dibutylphosphate, dipentylphosphate, dihexylphosphate, diheptylphosphate, and dioctylphosphate; ((alkyl)aryl) thiophosphates wherein the aryl or alkylaryl group has 6 to 18 carbon atoms, such as diphenylthiophosphate, and ditolylthiophosphate; or di((alkyl)aryl)phosphates wherein the aryl or alkylaryl group has 6 to 18 carbon atoms, such as diphenylphosphate and ditolylphosphate; and of the above-described nitrogen-containing compound among which preferred are aliphatic amines having straight-chain or branched alkyl or alkenyl group having 10 to 20 carbon atoms, such as decylamine, dodecylamine, tridecylamine, heptadecylamine, octadecylamine, and stearylamine.

No particular limitation is imposed on the content of Component (A) in the lubricating oil composition of the present invention. However, Component (A) is contained in an amount of preferably 0.01 to 5 percent by mass, more preferably 0.05 to 4 percent by mass, and particularly preferably 0.1 to 3 percent by mass. Component (A) of less than 0.01 percent by mass would fail to provide the resulting lubricating oil composition with sufficient anti-wear properties, while Component (A) in excess of 5 percent by mass would deteriorate the oxidation stability of the resulting composition.

The lubricating oil composition of the present invention may further contain preferably Component(s) (B) which is a compound of formula (3) below, i.e., the metal salt of dithiophosphate and/or a compound of formula (4) below, i.e., dithiophosphate or the metal or amine salt thereof. A lubricating oil composition containing Components (A) and (B) is slightly poor in the ability to maintain the base number but is improved in anti-wear properties, compared with a composition containing only Component (A), and is significantly improved in the ability to maintain the base number, compared with a composition containing Component (B) only. Therefore, the lubricating oil composition containing Components (A) and (B) is well-balanced in both of the properties.

Formula (3) is represented by

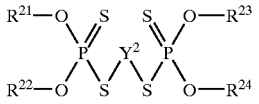

(3)

wherein $R^{21}$, $R^{22}$, $R^{23}$, and $R^{24}$ are each independently hydrogen or a hydrocarbon group having 1 to 30 carbon atoms, and $Y^2$ is a metal atom.

Formula (4) is represented by

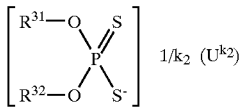

(4)

wherein $R^{31}$ and $R^{32}$ are each independently hydrogen or a hydrocarbon group having 1 to 30 carbon atoms, U is a monovalent metal ion, an ammonium ion or a proton, and $K^2$ is an integer of 1 to 20.

Component (B) is now described.

$R^{21}$, $R^{22}$, $R^{23}$, and $R^{24}$ in formula (3) are the same as $R^1$, $R^2$, $R^3$, and $R^4$ in formula (1). The preferred examples are also the same. $Y^2$ in formula (3) is the same as $Y^1$ in formula (1). The preferred examples are also same.

$R^{31}$ and $R^{32}$ in formula (4) are the same as $R^{11}$ and $R^{12}$. The preferred examples are also same. U and $k^2$ in formula (4) are the same as U and $k^1$ in formula (2). The preferred examples are also same.

Specific examples of the compound of formula (3) are zinc dialkyldithiophosphates wherein the alkyl group may be straight-chain or branched and has 3 to 18 carbon atoms, such as zinc dipropyldithiophosphate, zinc dibutyldithiophosphate, zinc dipentyldithiophosphate, zinc dihexyldithiophosphate, zinc diheptyldithiophosphate, and zinc dioctyldithiophosphate; zinc di((alkyl)aryl) dithiophosphates wherein the aryl or alkylaryl group has 6 to 18 carbon atoms, such as zinc diphenyldithiophosphate and zinc ditolyldithiophosphate; and those wherein the zinc is replaced by copper, iron, lead, nickel, silver, and manganese.

The compound of formula (4) is preferably the amine salt of dithiophosphate. Specific examples of the compound of formula (4) are the salts of dialkyldithiophosphates wherein the alkyl group may be straight-chain or branched and has 3 to 18 carbon atoms, such as dipropyldithiophosphate, dibutyldithiophosphate, dipentyldithiophosphate, dihexyldithiophosphate, diheptyldithiophosphate, and dioctyldithiophosphate; or ((alkyl)aryl)dithiophosphates wherein the aryl or alkylaryl group has 6 to 18 carbon atoms, such as diphenyldithiophosphate and ditolyldithiophosphate; and the above-described nitrogen-containing compounds among which preferred are aliphatic amines having straight-chain or branched alkyl or alkenyl group having 10 to 20 carbon atoms, such as decylamine, dodecylamine, tridecylamine, heptadecylamine, octadecylamine, and stearylamine.

When Components (A) and (B) are mixed, ligand-exchange occurs. More specifically, when compounds of formulae (5) and (6) are mixed, a compound of formula (7) is formed together with these compounds:

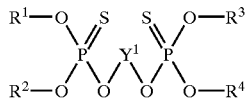

(5)

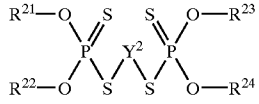

(6)

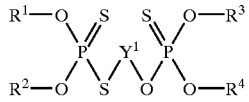

(7)

That is, the mixing of Components (A) and (B) brings the ligand-exchange therebetween, and thus a compound wherein 0 to 4 of $X^1$, $X^2$, $X^3$, and $X^4$ are oxygen may be present. However, the lubricating oil composition of the present invention may contain such a compound.

When Component (B) is contained in the lubricating oil composition, no particular limitation is imposed on the content of Component (B) in the lubricating oil composition of the present invention. However, Component (B) is contained in an amount of preferably 0.01 to 5 percent by mass, more preferably 0.05 to 4 percent by mass, and particularly preferably 0.1 to 3 percent by mass, based on the total mass of the composition. Component (B) of less than 0.01 percent by mass or no Component (B) would result in a composition which is extremely excellent in oxidation stability (base number maintaining properties at elevated temperature or in the presence of NOx) but fail to provide synergistic effects with Component (A) in terms of anti-wear properties, while Component (B) in excess of 5 percent by mass would deteriorate the oxidation stability of the resulting composition.

When the lubricating oil composition of the present invention further contain Component (B), no particular limitation is imposed on the upper limit of the mass ratio of Component (B) to Component (A). However, with the objective of the decrease of sulfur and the base number maintaining properties, the ratio is preferably 2 or less, more preferably 1.5 or less, and particularly preferably 1 or less. No particular limitation is imposed on the lower limit of such a ratio either. However, the lower limit is preferably 0.1 or more, and particularly preferably 0.3 or more because the synergistic effects can be expected in terms of anti-wear properties and the base number maintaining properties. Particularly, the base number maintaining properties and anti-wear properties can be synergistically improved by mixing Compound (B) with two Components (A) of formula (1), one of in which all of $X^1$, $X^2$, $X^3$, and $X^4$ are oxygen and the other of in which two of those are oxygen, in a mass ratio of 0.5 or more.

The lubricating oil composition of the present invention may further contain preferably at leas one additive selected from the group consisting of (C) a metal detergent, (D) an ashless dispersant, and (E) an oxidation inhibitor which are described in this order.

(C) Metal Detergents

Metal detergents are used preferably for improving the acid-neutralizing properties, high-temperature detergency, and anti-wear properties of the resulting lubricating oil composition.

Eligible metal detergents are any ones which are usually used in a lubricating oil. Specific examples are one or more metal detergents selected from alkali metal or alkaline earth metal sulfonates, alkali metal or alkaline earth metal phenates, and alkali metal or alkaline earth metal salicylates.

Specific examples of the alkali metal or alkaline earth metal sulfonates are alkaline earth metal salts preferably the sodium, potassium, magnesium or calcium salt, more preferably the magnesium or calcium salt of an alkyl aromatic sulfonic acid obtained by sulfonating an alkyl aromatic compound having a molecular weight of 300 to 1500, preferably 400 to 700.

Specific examples of the alkyl aromatic sulfonic acid are petroleum sulfonic acids and synthetic sulfonic acids. The petroleum sulfonic acid may be mahogany acid obtained by sulfonating an alkyl aromatic compound contained in the lubricant fraction of mineral oil or by-produced upon production of white oil. The synthetic sulfonic acid may be those obtained by sulfonating an alkyl benzene having a straight-chain or branched alkyl group, which may be by-produced from a plant for producing an alkyl benzene used as materials of detergents, or sulfonating dinonylnaphthalene. Although not restricted, there may be used fuming sulfuric acid and sulfuric anhydride as a sulfonating agent.

Specific examples of the alkali metal or alkaline earth metal phenates are the alkali metal salts or alkaline earth metal salts preferably the sodium, potassium, magnesium or calcium salts, of alkylphenols, alkylphenolsulfides or the Mannich reaction products of alkylphenols as represented by formulae (8) through (10):

(8)

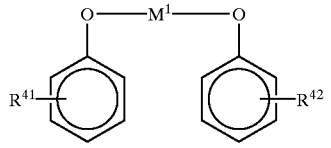

(9)

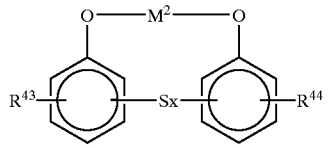

(10)

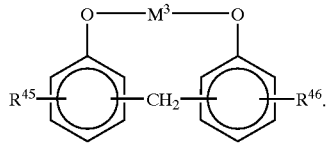

In formulae (8) through (10), $R^{41}$, $R^{42}$, $R^{43}$, $R^{44}$, $R^{45}$, and $R^{46}$ may be the same or different and are each independently a straight-chain or branched alkyl group having 4 to 30, preferably 6 to 18 carbon atoms, $M^1$, $M^2$, and $M^3$ are each independently an alkali metal or alkaline earth metal, preferably calcium or magnesium, and x is an integer of 1 or 2.

Specific examples of the alkyl group of $R^{41}$, $R^{42}$, $R^{43}$, $R^{44}$, $R^{45}$, and $R^{46}$ are butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups. These alkyl groups may be straight-chain or branched and may be of primary, binary or tertiary.

Specific examples of the alkali metal or alkaline earth metal salicylates are the alkali metal salt or alkaline earth metal salts, preferably sodium, potassium, magnesium and calcium of alkyl salicylic acid as represented by formula (11):

(11)

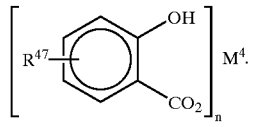

In formula (11), $R^{47}$ is a straight-chain or branched alkyl group having 4 to 30, preferably 6 to 18 carbon atoms, n is an integer of 1 or 2, and $M^4$ is an alkali metal or alkaline earth metal, preferably calcium or magnesium, and particularly preferably calcium.

Specific examples of the alkyl group of $R^{47}$ are butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups. These alkyl groups may be straight-chain or branched and may be of primary, binary or tertiary.

The alkali metal or alkaline earth metal sulfonate, alkali metal or alkaline earth metal phenates and alkali metal or alkaline earth metal salicylates may be those obtained by reacting an alkylaromatic sulfonic acid, alkylphenol, alkylphenolsuflide, the Mannich reaction product of an alkylphenolsulfide or an alkyl salicylic acid directly with an alkali metal or alkaline earth metal base such as the oxide or hydroxide of an alkali metal or alkaline earth metal.

Preferred for the present invention are the alkaline earth metal-based detergents. Other than the above-described neutral (normal salt) alkaline earth metal sulfonates, alkaline earth metal phenates and alkaline earth metal salicylates, the detergent may be a basic alkaline earth metal sulfonate, basic alkaline earth metal phenate and basic alkaline earth metal salicylate obtained by heating the neutral alkaline earth metal sulfonate, alkaline earth metal phenate or alkaline earth metal salicylate with an excess amount of alkaline earth metal salt or alkaline earth metal base in the presence of water; and an overbased alkaline earth metal sulfonates, overbased alkaline earth metal phenates and overbased alkaline earth metal salicylates obtained by reacting the hydroxide of an alkaline earth metal with carbonic acid gas or boric acid in the presence of the neutral alkaline earth metal sulfonate, alkaline earth metal phenate or alkaline earth metal salicylate.

No particular limitation is imposed on the total base number of the alkali metal- or alkaline earth metal-based detergents. Therefore, there may be used detergents having a total base number of 0 to 500 mgKOH/g. However, because of the excellent base number maintaining properties and high-temperature detergency and particularly excellent anti-wear properties, it is preferred to use a detergent having a total base number of 150 to 400 mgKOH/g, and preferably 200 to 350 mgKOH/g. Alternatively, because of the excellent anti-wear properties and particularly excellent base number maintaining properties and high-temperature detergency, there may be used a detergent having a total base number of less than 150 mgKOH/g, and preferably less than 130 mgKOH/g. The term "total base number" used herein denotes a total base number measured by the perchloric acid potentiometric titration method in accordance with section 7 of JIS K2501 (1992) "Petroleum products and lubricants-Determination of neutralization number". A metallic detergent can be often classified by metal ratio which is the content of metal and soap in the detergent obtained by above producing method. The term "metal ratio" used herein denotes "the valence of metal element x metal element content (mol)/the content of organic acid soap group such as salicylic acid group or sulfonic acid group".

In the present invention, it is preferred to use alkali metal or alkaline earth metal salicylates and/or alkali metal or alkaline earth metal sulfonates because of their base number maintaining properties, high-temperature detergency and anti-wear properties.

More specific examples of use of the metal detergents with component (A) in this invention are as follows:

(1) Use of an alkali metal or alkaline earth metal salicylate thereby obtaining a composition which is particularly excellent in base number maintaining properties and high-temperature detergency and excellent in anti-wear properties;

(2) Use of an alkali metal or alkaline earth metal salicylate having a total base number of 150 to 400 mgKOH/g, preferably 200 to 350 mgKOH/g, and particularly preferably 200 to 300 mgKOH/g thereby obtaining a composition which is excellent in base number maintaining properties and high-temperature detergency and particularly excellent in anti-wear properties particularly for the moving valve system of an internal combustion engine;

(3) Use of an alkali metal or alkaline earth metal salicylate having a total base number of less than 150 mgKOH/g, preferably 60 to 130 mgKOH/g, and particularly preferably 60 to 100 mgKOH/g thereby obtaining a composition which is excellent in anti-wear properties and particularly excellent in base number maintaining properties and high-temperature detergency;

(4) Use of the combination of an alkali metal or alkaline earth metal salicylate having a total base number of less than 150 mgKOH/g, preferably 60 to 130 mgKOH/g, and particularly preferably 60 to 100 mgKOH/g and an alkali metal or alkaline earth metal salicylate having a total base number of 150 mgKOH/g or greater than 150 mgKOH/g, preferably 160 to 350 mgKOH/g, and particularly preferably 160 to 300 mgKOH/g thereby obtaining a composition which is excellent in anti-wear properties and particularly excellent in base number maintaining properties and detergency at elevated temperatures;

(5) Use of an alkali metal or alkaline earth metal sulfonate having a total base number of preferably 150 to 400 mgKOH/g, more preferably 200 to 350 mgKOH/g, and particularly preferably 250 to 350 mgKOH/g thereby obtaining a composition which is excellent in properties of maintaining base number, acid number and viscosity in the presence of NOx and particularly excellent in anti-wear properties particularly for the moving valve system of an internal combustion engine; and (6) Use of the combination of an alkali metal or alkaline earth metal salicylate having a total base number of less than 150 mgKOH/g, preferably 60 to 130 mgKOH/g, and particularly preferably 60 to 100 mgKOH/g and an alkali metal or alkaline earth metal sulfonate having a total base number of preferably 150 to 400 mgKOH/g, more preferably 200 to 350 mgKOH/g, and particularly preferably 250 to 350 mgKOH/g thereby obtaining a composition which is particularly excellent in properties of maintaining base number, acid number and viscosity in the presence of NOx and excellent anti-wear properties.

Commercially available metallic detergents are usually diluted with a light lubricating base oil. It is preferred to use metal-based detergents of which metal content is within the range of 1.0 to 20 percent by mass, preferably 2.0 to 16 percent by mass.

No particular limitation is imposed on the content of Component (C). However, Component (C) is contained in an amount of 0.1 to 15.0 percent by mass, preferably 0.1 to 10 percent by mass, more preferably 0.5 to 8.0 percent by mass, and particularly preferably 1.0 to 5.0 percent by mass, based on the total mass of the composition. Component (C) of less than 0.1 percent by mass would be poor in high-temperature detergency and anti-wear properties, while Component (C) in excess of 15.0 percent by mass would fail to provide such an effect as being expected.

When using the detergents of (4) and (6) above, the content of an alkali metal or alkaline earth metal salicylate having a total base number of less than 150 mgKOH/g (about 2.6 or less, preferably 2.0 or less, particularly preferably 1.5 or less in metal ratio is 0.1 percent by mass or more, preferably 0.5 percent by mass or more, and particularly preferably 1.0 percent by mass or more and is 15 percent by mass or less, preferably 5.0 percent by mass or less, and particularly preferably 3.0 percent by mass or less. The use of the combination of an alkali metal or alkaline earth metal salicylate having a total base number of less than 150 mgKOH/g and an alkali metal or alkaline earth metal salicylate having a total base number of 150 to 400 mgKOH/g and/or an alkali metal or alkaline earth metal sulfonate having a total base number of 150 to 400 mgKOH/g can decrease the content of the metal detergent and can synergistically perform the effects of the present invention.

(D) Ashless Dispersant

Ashless dispersants are used preferably for improving the acid-neutralizing properties, base number maintaining properties, high-temperature detergency and anti-wear properties of the resulting composition.

Ashless dispersants may be any ones which are usually used in a lubricating oil. For example, there may be used nitrogen-containing compounds having in the molecules at least one straight-chain or branched alkyl or alkenyl group having 40 to 400 carbon atoms, or the derivative thereof, or the modified products of alkenyl succinimides. One or more of these may be added.

The alkyl or alkenyl group has 40 to 400, preferably 60 to 350 carbon atoms. The alkyl or alkenyl group having less than 40 carbon atoms would adversely affect the solubility of the compound in a base oil, while the alkyl or alkenyl group having more than 400 carbon atoms would deteriorate the low-temperature flowability of the resulting lubricating oil composition. The alkyl or alkenyl group may be straight-chain or branched and is preferably a branched alkyl or alkenyl group derived from the oligomer of an olefin such as propylene, 1-butene, and isobutylene or the cooligomer of ethylene and propylene.

No particular limitation is imposed on the nitrogen content of the nitrogen-containing compound. However, it is preferred to use a nitrogen-containing compound containing nitrogen in an amount of 0.01 to 10 percent by mass, preferably 0.1 to 10 percent by mass with the objective of base number maintaining properties, high-temperature detergency and anti-wear properties.

Specific examples of Component (D) are the following compounds. Component (D) may be one or more of these compounds.

(D-1) succinimides having in the molecules at least one alkyl or alkenyl group having 40 to 400 carbon atoms, or the derivatives thereof (D-2) benzylamines having in the molecules at least one alkyl or alkenyl group having 40 to 400 carbon atoms, or the derivatives thereof (D-3) polyamines having in the molecules at least one alkyl or alkenyl group having 40 to 400 carbon atoms, or the derivatives thereof (D-1) succinimides are exemplified by compounds represented by formulae (12) and (13)

(12)

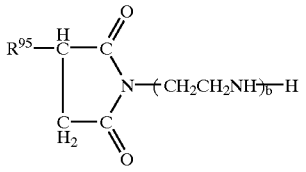

wherein $R^{95}$ is an alkyl or alkenyl group having 40 to 400, preferably 60 to 350 carbon atoms, and b is an integer of 1 to 5, preferably 2 to 4; and (13)

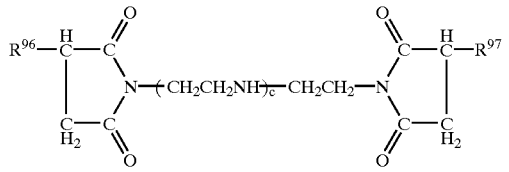

wherein $R^{96}$ and $R^{97}$ are each independently an alkyl or alkenyl group having 40 to 400, preferably 60 to 350 carbon atoms and preferably polybutenyl, and c is an integer of 0 to 4, preferably 1 to 3.

The succinimides are classified by a mono-type succinimide wherein succinic anhydride is added to one end of a polyamine as represented by formula (12) and a bis-type succinimide wherein succinic anhydride is added to both ends of a polyamine as represented by formula (13). In the present invention, both types of the succinimides and mixtures thereof can be used as Component (D-1).

No particular limitation is imposed on the method of producing these succinimides. For example, the succinimides may be produced by reacting an alkyl or alkenyl succinimide resulting from the reaction of an alkyl or alkenyl group having 40 to 400 carbon atoms with maleic anhydride at a temperature of 100 to 200° C., with a polyamine. Specific examples of the polyamine are diethylenetriamine, triethylenetetramine, tetraethylenepentamine, and pentaethylenehexamine.

(D-2), i.e., benzylamines are exemplified by compounds represented by formula (14)

(14)

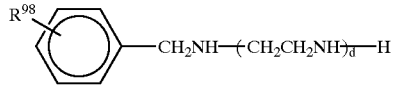

wherein $R^{98}$ is an alkyl or alkenyl group having 40 to 400, preferably 60 to 350 carbon atoms, and d is an integer of 1 to 5, preferably 2 to 4.

No particular limitation is imposed on the method of producing the benzylamine. For example, the benzylamine may be produced by subjecting an alkylphenol resulting from the reaction of a polyolefin such as propyleneoligomer, polybutene, and ethylene-α-olefin copolymer with phenol, to the Mannich reaction with formaldehyde and a polyamine such as diethylenetriamine, triethylenetetramine, tetraethylenepentamine, and pentaethylenehexamine.

(D-3), i.e., polyamines are exemplified by compounds represented by formula (15)

(15)

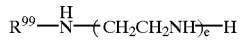

wherein $R^{99}$ is an alkyl or alkenyl group having 40 to 400, preferably 60 to 350 carbon atoms, and e is an integer of 1 to 5, preferably 2 to 4.

No particular limitation is imposed on the method of producing the polyamines. For example, the polyamines may be produced by subjecting a polyolefin such as propyleneoligomer, polybutene, and an ethylene-α-olefin copolymer to chloridization, followed by the reaction with ammonia or a polyamine such as ethylenediamine, diethylenetriamine, triethylenetetramine, tetraethylenepentamine, and pentaethylenehexamine.

Specific examples of the derivatives of the nitrogen-containing compound are oxygen-modified compounds obtained by bringing the above-described nitrogen-containing compound into the reaction with a monocarboxylic acid having 1 to 30 carbon atoms, such as fatty acid or a polycarboxylic acid having 2 to 30 carbon atoms, such as oxalic acid, phthalic acid, trimellitic acid, and pyromellitic acid so as to neutralize or amidize the part or whole of the remaining amino and/or imino groups; boron-modified compounds obtained by bringing the above-described nitrogen-containing compound into the reaction with boric acid so as to neutralize or amidize the part or whole of the remaining amino and/or imino groups; sulfur-modified compounds obtained by bringing the above-described nitrogen-containing compound into the reaction with a sulfuric compound; and modified products obtained by bringing the above-described nitrogen-containing compound into a combination of 2 or more selected from the oxygen modification, boron modification, and sulfur modification. Among these derivatives, the boron-modified compounds of alkenyl succinimides are excellent in heat resistance and effective in the enhancement of the base number maintaining properties of the resulting composition.

No particular limitation is imposed on the content of Component (D). However, Component (D) is contained in an amount of 0.01 to 20 percent by mass, preferably 0.1 to 10 percent by mass, based on the total mass of the composition. Component (D) of less than 0.01 percent by mass is less effective in base number maintaining properties, high-temperature detergency, and anti-wear properties while Component (D) in excess of 20 percent by mass would deteriorate the low-temperature flowability of the resulting composition significantly.

(E) Oxidation Inhibitor

Eligible oxidation inhibitors are phenol- and amine-based oxidation inhibitors which are usually used in lubricating oils. The addition of the oxidation inhibitor can enhance the anti-oxidation properties of the resulting composition, leading to the enhancement of the ability to maintain the base number.

Specific examples of the phenol-based oxidation inhibitors are 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-4-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl)propionate, pentaerythrityl-tetraquis[3-(3,5-di-tert-butyl-4-hydroxyphenyl)propionate], octadecyl-3-(3,5-di-tert-butyl-4-hydroxyphenyl)propionate, and mixtures thereof.

Specific examples of the amine-based oxidation inhibitors are phenyl-α-naphtylamine, alkylphenyl-α-naphtylamine, dialkyldiphenylamine, and mixtures thereof.

The phenol- and amine-based oxidation inhibitors may be used in combination.

The upper limit content of the above-described ashless oxidation inhibitors is 3.0 percent by mass, preferably 2.0 percent by mass based on the total mass of the composition. A content in excess of the upper limit would fail to achieve oxidation inhibition that balances the amount. No particular limitation is imposed on the lower limit content. However, the lower limit content of preferably 0.01 percent by mass, more preferably 0.1 percent by mass, and particularly preferably 0.8 percent by mass based on the total mass of the composition is contributive to the further enhancement of the base number maintaining properties and high-temperature detergency.

Although the lubricating oil composition of the present invention are excellent in base number maintaining properties and anti-wear properties, for the purpose of further enhancing these properties and various requisite properties of lubricating oils, it may be blended with known lubricant additives in such an amount that the properties of the inventive lubricating oil composition are not extremely deteriorated. Examples of such additives are viscosity index improvers, anti-wear agents other than Components (A), friction modifiers, corrosion inhibitors, rust inhibitors, anti-emulsifiers, metal deactivators, anti-foaming agents and dyes.

Viscosity index improvers can be added in the composition of this invention to modify the viscosity properties with respect to temperature. On the other hand, viscosity index improvers often deteriorate the high-temperature detergency of a lubricating oil composition. However, the composition of this invention can keep excellent high-temperature detergency even if it contains viscosity index improvers. If viscosity index improver is not added or added in a small amount of, for example, less than 1% by mass in the composition, the high-temperature detergency of the composition of this invention becomes extremely excellent.

Specific examples of the viscosity index improvers are non-dispersion type viscosity index improvers such as copolymers of one or monomers selected from various methacrylates and the hydrides thereof, dispersion type viscosity index improvers such as copolymers of various methacrylates further containing nitrogen compounds, non-dispersion- or dispersion-type ethylene-α-olefin copolymers wherein the α-olefin may be propylene, 1-butene, or 1-pentene, or the hydrides thereof, polyisobutylenes or the hydrogenated products thereof, styrene-diene hydrogenated copolymers, styrene-maleate anhydride copolymers, and polyalkylstyrenes.

It is necessary to select the molecular weight of these viscosity index improvers considering the shear stability. Specifically, the weight-average molecular weight of the non-dispersion or dispersion type viscosity index improvers is preferably from5,000 to 1,000,000, and more preferably 10,000 to 350,000. The weight-average molecular weight of the polyisobutylene or the hydrides thereof is 800to 5,000, preferably 1,000 to 4,000. The ethylene-α-olefin copolymers and the hydrides thereof have a weight-average molecular weight of 800 to 500,000, preferably 1,000 to 200,000.

Among these viscosity index improvers, the use of ethylene-α-olefin copolymers and the hydrides thereof results in a lubricating oil composition which is excellent particularly in shear stability. One or more of compounds selected from the above-described viscosity index improvers may be added in any suitable amount. The content of the viscosity index improvers is 0.1 to 20.0 percent by mass based on the total mass of the lubricating oil composition.

Specific examples of the anti-wear agents other than Component (A) are phosphite, the amine salt thereof, disulfides, olefin sulfides, and sulfurized fats and oils.

Specific examples of the friction modifiers are molybdenum dithiocarbamate, molybdenum dithiophosphate, molybdenum disulfide, long-chain aliphatic amines, long-chain fatty acids, long-chain fatty acid esters, long-chain aliphatic alcohols.

Examples of the corrosion inhibitor are benzotriazole-, tolyltriazole-, thiadiazole-, and imidazole-based compounds.

Examples of the rust inhibitor are petroleum sulfonates, alkylbenzensulfonates, dinonylnaphthalene sulfonates, alkenylsuccinates, polyalcohol esters such as glycerin monooleate and sorbitan monooleate, and amines.

Examples of the anti-emulsifier are polyalkylene glycol-based non-ionic surfactants such as polyoxyethylenealkyl ether, polyoxyethylenealkylphneyl ether, and polyoxyethylenealkylnaphthyl ether.

Examples of the metal diactivator are imidazoline, pyrimidine derivatives, alkylthiadiazole, mercaptobenzothiazole, benzotriazole and derivatives thereof, 1,3,4-thiadiazolepolysulfide, 1,3,4-thiadizolyl-2,5-bisdialkyldithiocarbamte, 2-(alkyldithio)benzoimidazole, and β-(o-carboxybenzylthio)propionnitrile.

Examples of the anti-foamers are silicone, fluorosilicone, and fluoroalkyl ether.

The content of each of the anti-wear agent other than Component (A), friction modifier, corrosion inhibitor, rust inhibitor and anti-emulsifier is 0.01 to 5 percent by mass based on the total mass of the composition. The content of the metal deactivator is 0.005 to 1 percent by mass based on the total mass of the composition. The content of the anti-foamer is 0.0005 to 1 percent by mass based on the total mass of the composition.

With the objective of the above-described base number maintaining properties, high-temperature detergency and low-sulfur content, the content of sulfur-based additive (effective component) is preferably 0.15 percent by mass or less, more preferably 0.1 percent by mass or less, and particularly preferably no sulfur-based additive. The sulfur content of the lubricating oil composition is preferably 0.3 percent by mass or less, more preferably 0.2 percent by mass or less, further preferably 0.1 percent by mass or less, and particularly preferably 0.05 percent by mass. When a diluting oil or solvent with low or no sulfur content is selected for the base oil or various additives, the sulfur content of the resulting oil composition can be further decreased. Therefore, this makes it possible to produce a composition which contains 0.05 percent by mass or less or of substantially no sulfur (0.01 percent by mass or less), resulting in further enhancement in base number maintaining properties and high-temperature detergency.

The lubricating oil composition of the present invention can be used preferably for internal combustion engines such as gasoline-, diesel- and gas-engines of motorcycles automobiles, dynamos, and ships. However, it can also be used more preferably as a lubricating oil for internal combustion engines using a gasoline, gas oil or kerosene containing sulfur in an amount of 100 mass ppm or less, preferably 50 mass ppm or less, and particularly preferably 20 mass ppm or less, or using a low-sulfur content fuel containing sulfur in an amount of 1 mass ppm or less, such as LPG, natural gas, dimethylether, alcohol, GTL (Gas to Liquid)fuel, such as gasoline fraction, kerosene fraction and light oil fraction. Furthermore, the lubricating oil composition can be used as a lubricating oil which is required to have anti-wear properties and long-drain properties, such as a lubricating oil for a driving system including an automatic or manual transmission and a wet-type brake, a hydraulic oil, and a turbine oil, a compressor oil, a bearing oil, and a refrigerating oil.

The present invention is now described in more detail with reference to Inventive Examples and Comparative Examples but is not limited thereto.

INVENTIVE EXAMPLES 1 TO 13, AND COMPARATIVE EXAMPLES 1 TO 3

There were prepared lubricating oil composition of the present invention (Inventive Examples 1 to 13), lubricating oil compositions (Comparative Examples 1 and 3) which are free of Component (A) but contained ZDTP, i.e., Component (B), and a lubricating oil composition (Comparative Example 2) which is free of Components (A) and (B). The composition and properties of each of the compositions are shown in Tables 1 and 2.

TABLE 1

| | | Inventive Examples | | | | | | Comparative Examples | |
|---|---|---|---|---|---|---|---|---|---|
| | | 1 | 2 | 3 | 4 | 5 | 6 | 1 | 2 |
| Lubricant Base Oil[1)] | mass % | 83.0 | 83.0 | 83.0 | 83.0 | 83.0 | 82.9 | 83.0 | 84.0 |
| (A) ZP[2)] | mass % | 1.0 | 0.3 | 0.5 | 0.8 | 0.25 | 0.4 | — | — |
| (A) ZMTP[3)] | mass % | — | — | — | — | 0.25 | — | — | — |
| (A) Amine Salt of Phosphate[4)] | mass % | — | — | — | — | — | 0.35 | — | — |
| (B) ZDTP[5)] | mass % | — | 0.7 | 0.5 | 0.2 | 0.5 | 0.4 | 1.0 | — |
| (C) Metal Detergent[6)] | mass % | 4.7 | 4.7 | 4.7 | 4.7 | 4.7 | 4.7 | 4.7 | 4.7 |
| (D) Ashless Despersant[7)] | mass % | 5.0 | 5.0 | 5.0 | 5.0 | 5.0 | 5.0 | 5.0 | 5.0 |
| (E) Oxidation Inhibitor[8)] | mass % | 1.0 | 1.0 | 1.0 | 1.0 | 1.0 | 1.0 | 1.0 | 1.0 |
| Other Additives[9)] | mass % | 5.0 | 5.0 | 5.0 | 5.0 | 5.0 | 5.0 | 5.0 | 5.0 |
| Kinematic Viscosity (40° C.) | $mm^2/s$ | 72.08 | 66.1 | 67.97 | 70.95 | 68.28 | 64.09 | 64.44 | 62.6 |
| Kinematic Viscosity (100° C.) | $mm^2/s$ | 11.43 | 10.74 | 10.96 | 11.32 | 11.04 | 10.46 | 10.66 | 10.56 |
| Total Acid Number | mgKOH/g | 3.12 | 2.56 | 2.93 | 3.47 | 2.76 | 2.79 | 2.34 | 0.94 |
| Total Base Number (HCl method) | mgKOH/g | 9.41 | 9.81 | 9.93 | 10.2 | 9.88 | 8.93 | 11.1 | 8.8 |
| Element Concentration | | | | | | | | | |
| Ca | mass % | 0.28 | 0.28 | 0.28 | 0.28 | 0.28 | 0.29 | 0.29 | 0.28 |
| P | mass % | 0.11 | 0.10 | 0.10 | 0.12 | 0.10 | 0.11 | 0.08 | 0.00 |
| Zn | mass % | 0.12 | 0.11 | 0.12 | 0.12 | 0.10 | 0.08 | 0.08 | 0.00 |
| S | mass % | 0.11 | 0.26 | 0.21 | 0.16 | 0.15 | 0.16 | 0.29 | 0.09 |

TABLE 1-continued

| | | Inventive Examples | | | | | | Comparative Examples | |
|---|---|---|---|---|---|---|---|---|---|
| | | 1 | 2 | 3 | 4 | 5 | 6 | 1 | 2 |
| N | mass % | 0.14 | 0.14 | 0.11 | 0.14 | 0.14 | 0.17 | 0.13 | 0.13 |

1)hydrogenated refined mineral oil, kinematic viscosity at 100° C.: 4.7 $mm^2/s$, viscosity index: 120

2)a compound of formula (1) wherein $Y^1$ is zinc, all of $X^1$ to $X^4$ are oxygen, and $R^1$ to $R^4$ are each 2-ethylhexyl 3)a compound of formula (1) wherein $Y^1$ is zinc, two of $X^1$ to $X^4$ are oxygen, the others are sulfur, and $R^1$ to $R^4$ are each propyl or hexyl 4)a compound of formula (2) wherein $X^1$ and $X^2$ are oxygen, $R^1$ and $R^2$ are each 2-ethylhexyl, and U is the ammonium ion of oleylamine, K1 is 1.

5)a compound of formula (3) wherein $Y^2$ is zinc, and $R^{21}$ to $R^{24}$ are each 4-methyl-2-pentyl 6)calcium salicylate, total base number: 170 mgKOH/g, calcium content: 6 percent by mass 7)polybutenyl succinimide, nitrogen content: 1.3 percent by mass, weight-average molecular weight: 4000

8)4,4'-methylenebis-2,6-di-tert-butylphenol 9)additive containing viscosity index improvers (PMA, OCP) and anti-foaming agent

TABLE 2

| | | | | | | | | | |
|---|---|---|---|---|---|---|---|---|---|
| Lubricant Base Oil1) | mass % | 81.8 | 82.3 | 82.8 | 82.8 | 83.1 | 84.55 | 85.00 | 82.55 |
| (A) ZP2) | mass % | — | — | — | — | 0.7 | 0.6 | 0.6 | — |
| (A) CaP3) | mass % | — | — | — | 1.0 | — | — | — | — |
| (A) ZMTP4) | mass % | — | — | 1.0 | — | — | — | — | — |
| (A) Amine Salt of Phosphate5) | mass % | 1.5 | — | — | — | — | — | — | — |
| (A) Dialkylphophate6) | mass % | — | 1.0 | — | — | — | — | — | — |
| (B) ZDTP7) | mass % | — | — | — | — | — | — | — | 0.25 |
| (B) ZDTP8) | mass % | — | — | — | — | — | — | — | 1.0 |
| (C) Metal Detergent | mass % | 4.7 | 4.7 | 4.2 | 4.2 | 4.2 | — | — | 4.2 |
| (C) Metal Detergent10) | mass % | — | — | — | — | — | 2.85 | — | — |
| (C) Metal Detergent11) | mass % | — | — | — | — | — | — | 2.4 | — |
| (D) Ashless Despersant12) | mass % | 5.0 | 5.0 | 5.0 | 5.0 | 5.0 | 5.0 | 5.0 | 5.0 |
| (E) Oxidation Inhibitor13) | mass % | 2.0 | 2.0 | 2.0 | 2.0 | 2.0 | 2.0 | 2.0 | 2.0 |
| Other Additives14) | mass % | 5.0 | 5.0 | 5.0 | 5.0 | 5.0 | 5.0 | 5.0 | 5.0 |
| Kinematic Viscosity (40° C.) | $mm^2/s$ | 63.82 | 63.37 | 63.37 | 62.33 | 60.89 | 59.4 | 56.05 | 58.18 |
| Kinematic Viscosity (100° C.) | $mm^2/s$ | 10.48 | 10.59 | 10.59 | 10.71 | 10.53 | 10.14 | 9.87 | 9.98 |
| Total Acid Number | mgKOH/g | 2.33 | 1.83 | 1.83 | 1.66 | 2.08 | 2.43 | 1.94 | 3.35 |
| Total Base Number (HCl method) | mgKOH/g | 7.78 | 6.15 | 6.15 | 8.89 | 8.82 | 8.67 | 8.31 | 8.76 |
| Element Concentration | | | | | | | | | |
| Ca | mass % | 0.29 | 0.29 | 0.26 | 0.32 | 0.26 | 0.27 | 0.29 | 0.26 |
| P | mass % | 0.11 | 0.09 | 0.09 | 0.09 | 0.09 | 0.08 | 0.08 | 0.11 |
| Zn | mass % | 0.00 | 0.00 | 0.00 | 0.00 | 0.10 | 0.08 | 0.08 | 0.10 |
| S | mass % | 0.01 | 0.01 | 0.10 | 0.01 | 0.01 | 0.01 | 0.04 | 0.19 |
| N | mass % | 0.21 | 0.13 | 0.15 | 0.15 | 0.15 | 0.12 | 0.13 | 0.15 |

1)high-grade hydrogenated refined mineral oil, kinematic viscosity at 100 ° C.: 5.6 $mm^2/s$, viscosity index: 130, aromatic content: 1.2 mass %, sulfur content: 10 mass ppm 2)a compound of formula (1) wherein $Y^1$ is zinc, all of $X^1$ to $X^4$ are oxygen, and $R^1$ to $R^4$ are each butyl 3)a compound of formula (1) wherein $Y^1$ is calcium, all of $X^1$ to $X^4$ are oxygen, and $R^1$ to $R^4$ are each 2-ethylhexyl 4)a compound of formula (1) wherein $Y^1$ is zinc, two of $X^1$ to $X^4$ are oxygen, the others are sulfur, and $R^1$ to $R^4$ are each 2-ethylhexyl 5)a compound of formula (2) wherein $X^{11}$ and $X^{12}$ are oxygen, $R^{11}$ and $R^{12}$ are 2-ethylhexyl, U is the ammonium ion of oleylamine, k1 is 1

6)a compound of formula (2) wherein $X^{11}$ and $X^{12}$ are oxygen, $R^{11}$ and $R^{12}$ are 2-ethylhexyl, U is proton 7)a compound of formula (3) wherein $Y^2$ is zinc, and $R^{21}$ to $R^{24}$ are 2-ethylhexyl 8)a compound of formula (3) wherein $Y^2$ is zinc, and $R^{21}$ to $R^{24}$ are 1,3-dimethylbutyl 9)calcium salicylate, total base number: 170 mgKOH/g, calcium content: 6.2 percent by mass, metal ratio: 2.7

10)calcium salicylate, total base number: 280 mgKOH/g, calcium content: 9.5 percent by mass, metal ratio: 5.8

11)calcium sulfonate, total base number: 300 mgKOH/g, calcium content: 12.0 percent by mass, metal ratio: 10.0, sulfur content: 1.2 percent by mass 12)a mixture of polybutenyl succinimide (bis-type, number-average molecular weight of polybutenyl: 1,300, nitrogen content: 1.5 percent by mass and a boric acid-modified product thereof, 13)octyl-3-(3,5-di-t-butyl4-hydroxyphenyl)propionate and alkyldiphenylamine (1:1)

9)additive containing viscosity index improvers (PMA, OCP) and anti-foaming agent The performances of each of the compositions of Inventive Examples 1 to 13 and Comparative Examples 1 to 3 were evaluated by the following tests.

Figure 2:
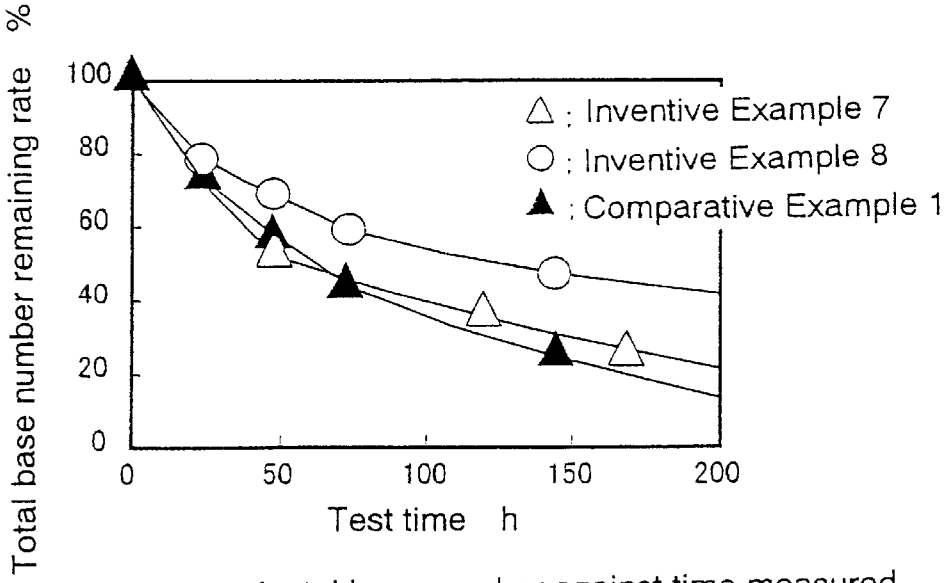
FIG. 2 is a graphical plot of the change of total base number against time of the lubricating oil compositions of Inventive Examples 7 and 8 and Comparative Example 1 measured in accordance with ISOT.

(1) The Change of Total Base Number With the Lapse of Time in Accordance with ISOT Test The remaining rate of total base number of each of the sample oils when were forced to deteriorate was measured at a temperature of 150° C. by ISOT test in accordance with JIS K 2514. The results are shown in FIGS. 1 and 2. The smaller the decrease of the total base number, the better the base number maintaining properties are. This means that an oil is a long-drain oil which can be used for a longer time.

As shown in FIG. 1, the lubricating oil composition of Inventive Example 1 was extremely more improved in base number maintaining properties than that of Comparative Example 1. The lubricating oil compositions of Inventive Examples 2, 3 and 4 all containing both Components (A) and (B) were improved in base number maintaining properties, compared with that of Comparative Example 1. The oil composition of Inventive Example 5 obtained by substituting a half of the ZP of Component (A) of Inventive Example 3 by ZMTP was more improved in base number maintaining properties than that of Inventive Example 3. This means that a lubricating oil composition containing ZP, ZMTP and ZDTP in combination is synergistically improved in base number maintaining properties and thus has excellent long-drain properties.

FIG. 2 shows that the lubricating oil compositions of Inventive Examples 7 and 8 were improved in base number maintaining properties, compared with that of Comparative Example 1 as well. It was also confirmed that the lubricating oil compositions of Inventive Examples 6, 9 and 10 were improved in base number maintaining properties, compared with that of Comparative Example 1.

Figure 3:
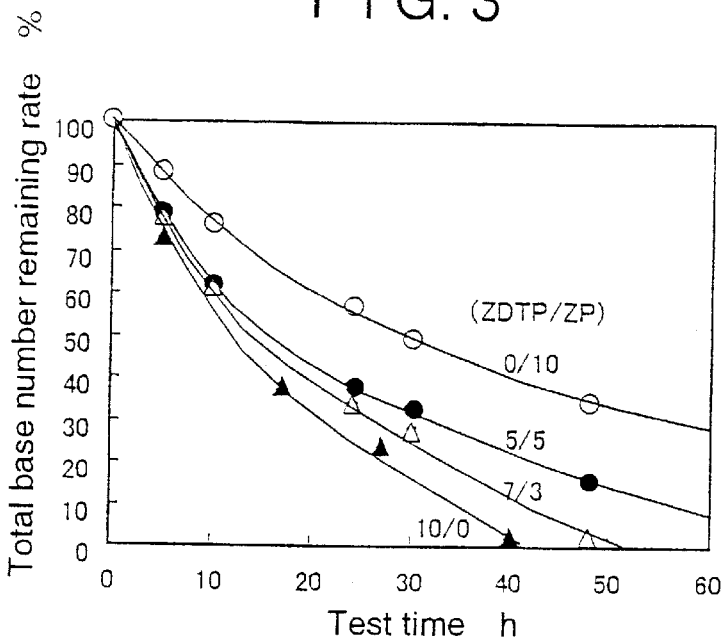
FIG. 3 is a graphical plot of the change of total base number against time of the lubricating oil compositions of Inventive Examples 1 to 3 and Comparative Example 1 measured in accordance with NOx absorbing test.
Figure 4:
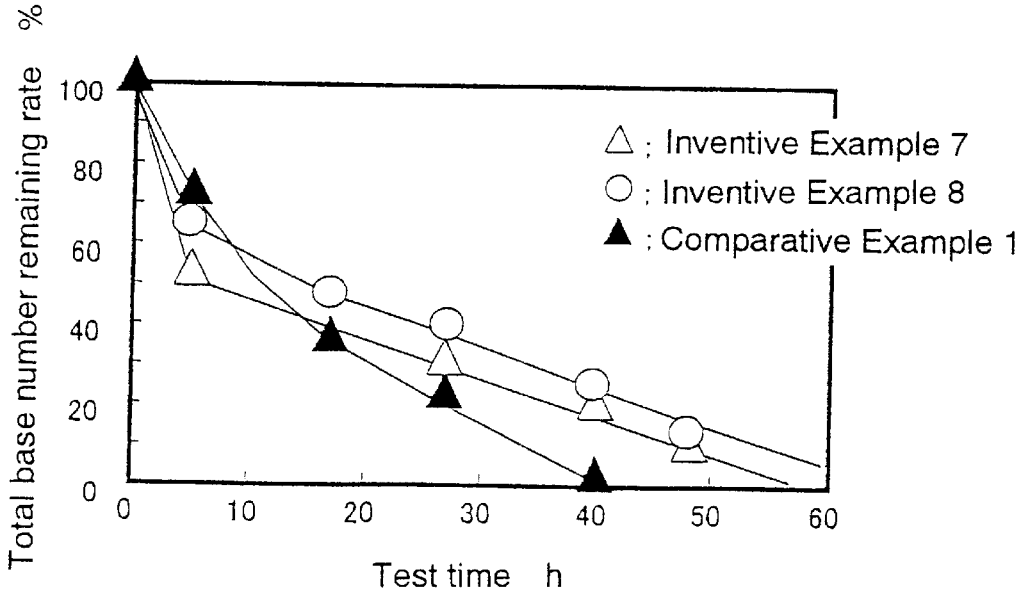
FIG. 4 is a graphical plot of the change of total base number against time of the lubricating oil compositions of Inventive Examples 7 and 8 and Comparative Example 1 measured in accordance with NOx absorbing test.
Figure 5:
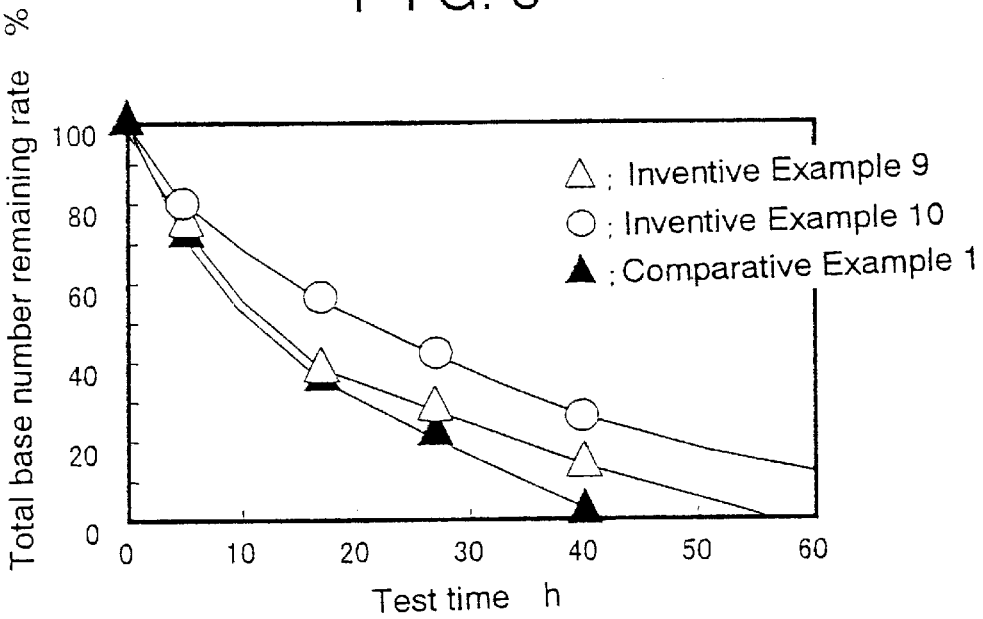
FIG. 5 is a graphical plot of the change of total base number against time of the lubricating oil compositions of Inventive Examples 9 and 10 and Comparative Example 1 measured in accordance with NOx absorbing test.

(2) The Change of Total Base Number With the Lapse of Time in Accordance With NOx Absorbing Test The change of total base number with the lapse of time of each of the sample oils which were forced to deteriorate by blowing NOx gas thereto under the conditions (135° C., NOx: 1185 ppm) in accordance with the number of published paper 465, 10, 1992 issued by Japan Society of Tribologists Conference, was measured. The results are shown in FIGS. 3, 4 and 5. As shown in FIG. 3, an lubricating oil composition which is smaller in the decrease of the total base number was found to have better base number maintaining properties even in an internal combustion engine where NOx is present and thus be a long-drain oil which can be used for a longer time.

FIGS. 4 and 5 show that the lubricating oil compositions of Inventive Examples 7 to 10 had the same results. It was also confirmed that the lubricating oil compositions of Inventive Examples 6 was extremely excellent in base number maintaining properties, compared with that of Comparative Example 1.

(3) The Change of Total Base Number and Acid Number With the Lapse of Time in Accordance With JASO 1GFE High-temperature Oxidation Test A 100-hour operation was conducted under the conditions in accordance with JASO M 333-9, using gasoline of sulfur content of 10 ppm by mass as a fuel, in combination with each of the lubricating oil compositions of Inventive Examples 11 and 13 and Comparative Example 3 so as to measure the change of total base number and the increase of acid number with the lapse of time and kinematic viscosity increase rate with the lapse of time. The results are shown in FIGS. 6, 7 and 8.

Figure 6:
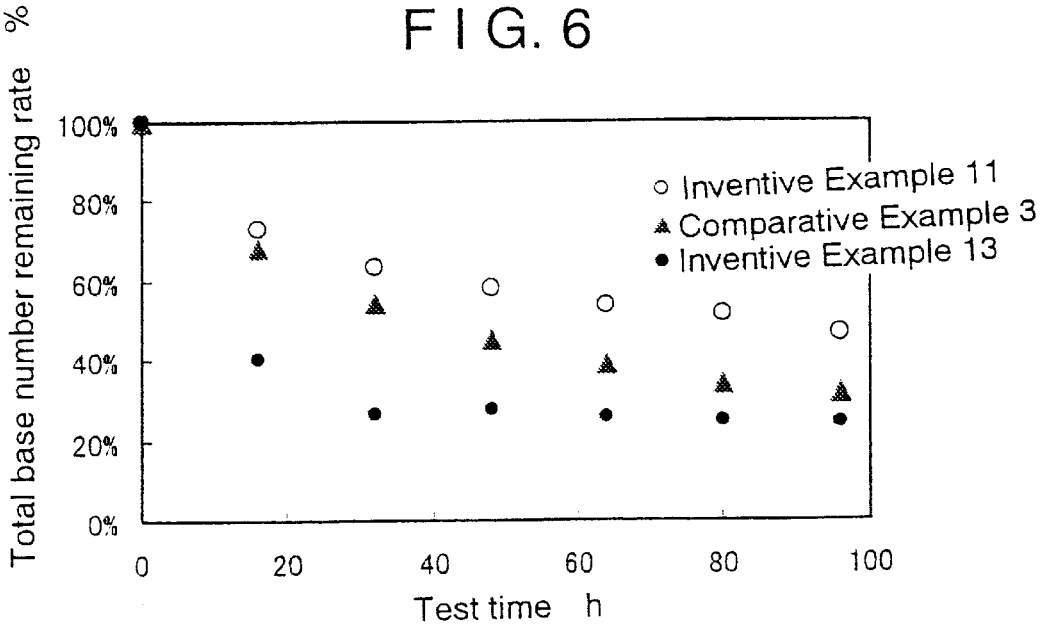
FIG. 6 is a graphical plot of the change of total base number against time of the lubricating oil compositions of Inventive Examples 11 and 13 and Comparative Example 3 measured in accordance with the 1 GFE high-temperature oxidation test of JASO.

FIG. 6 shows that the composition of Inventive Example 11 maintained nearly 50 percent of total base number after 100 hours, while the composition of Comparative Example 3 was decreased to about 30 percent. The composition of Inventive Example 13 was decreased in total base number to 25 percent till 30 hours past but was constant thereafter. Therefore, if the test was conducted for 100 hours or longer, there is a possibility that the composition of Inventive Example 13 would have exhibited more excellent base number remaining rate than that of Comparative Example 3. It was confirmed that a composition obtained by substituting ZP of the composition of Inventive Example 13 by ZDTP was poorer in base number maintaining properties than the composition of Inventive Example 13.

Figure 7:
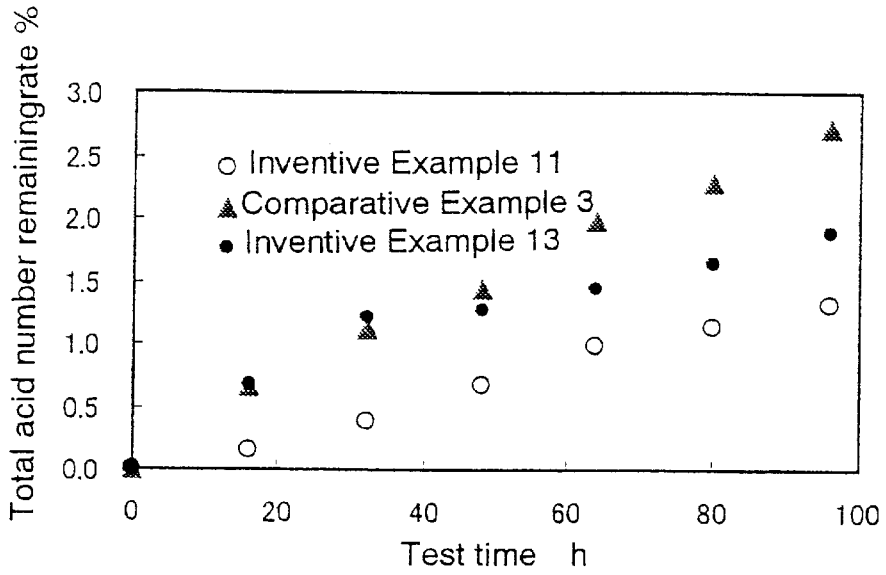
FIG. 7 is a graphical plot of the change of acid number increase against time of the lubricating oil compositions of Inventive Examples 11 and 13 and Comparative Example 3 measured in accordance with the 1 GFE high-temperature oxidation test of JASO.

As shown in FIG. 7, the increase of acid number of the lubricating oil composition of Inventive Example 8 was prevented from rising 1.5 mgKOH/g or more, while the acid number of the composition of Comparative Example 3 was in excess of 2.5 mgKOH/g. With a view to time consumed to reach the same base number remaining rate, for example, 50 percent or the same increase of acid number, for example, 1.5 mgKOH/g, the lubricating oil composition of Inventive Example 11 had long-drain properties as twice as better than that of Comparative Example 3. Therefore, the lubricating oil composition of the present invention has extremely excellent oxidation stability and long-drain properties. The composition of Inventive Example 13 exhibited an acid number increase which is equivalent to the composition of Comparative Example 3 up to 30 hours but was found to be decreased thereafter.

Figure 8:
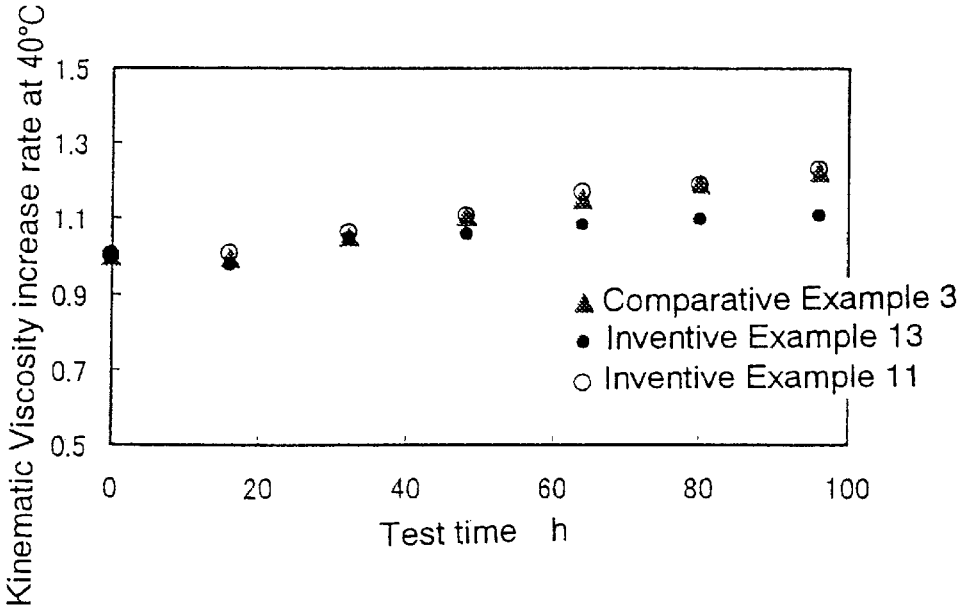
FIG. 8 is a graphical plot of the change of kinematic viscosity increase rate at 40° C. against time of the lubricating oil compositions of Inventive Examples 11 and 13 and Comparative Example 3 measured in accordance with the 1 GFE high-temperature oxidation test of JASO.

As shown in FIG. 8, with regard to the change of kinematic viscosity at 40° C. with a lapse of time, the composition of Inventive Example 11 was equivalent to and the composition of Inventive Example 13 was superior to the composition of Comparative Example 3. Therefore, the lubricating oil composition of the present invention was effective to prevent from being viscous.

(4) High-temperature Detergency Evaluated By a Hot Tube Test

A hot tube test was conducted in accordance with JPI-5S-5599. The results were graded from 10 points to 0 point. 10 points indicates colorless and transparent and 0 point indicates black and opaque. Between 10 and 0 point, evaluation was done using reference tubes which were made per grade beforehand. At 290° C., 6 points or higher indicates that the multi-grade oil composition has an excellent detergency for an ordinary gasoline or diesel engine. However, it is preferred that a lubricating oil composition for a gas engine exhibits an excellent detergency at 300° C. or higher as well in this test. Table 3 shows the results obtained using the lubricating oil compositions of Inventive Examples 7 to 12 and Comparative Example 3.

TABLE 3

| | Inventive Examples | | | | | | Comparative |
|---|---|---|---|---|---|---|---|
| Hot Tube Test (grade point) | 7 | 8 | 9 | 10 | 11 | 12 | Example 3 |
| 300° C. | 10 | 10 | 10 | 10 | 10 | 10 | 7 |
| 310° C. | 2 | 2 | 3 | 7 | 10 | 1 | 0 |
| 320° C. | 0 | 0 | 0 | 1 | 2 | 0 | 0 |

As apparent from the results in Table 3, the lubricating oil compositions of the present invention exhibited an excellent detergency at an elevated temperature of 300° C. or higher, and those of Inventive Examples 10 and 11 were found to exhibit an extremely excellent high-temperature detergency.

(5) High-velocity Four Ball Test and FALEX Test for Evaluating Anti-wear and Anti-seizuring Properties and Moving Valve Wear Test 1) High-velocity Four Ball Test High-velocity four ball test was conducted under the conditions of 1,800 rpm and 392 N at room temperature for 30 minutes in accordance with ASTM D4172-94. After the test, the average size of the scar of the tested balls caused by wear was measured. The results are shown in Tables 4 and 5. The smaller the scar size, the more the oil is excellent in anti-wear properties.

TABLE 4

| | | Inventive Examples | | | | | | Comparative Examples | |
|---|---|---|---|---|---|---|---|---|---|
| | | 1 | 2 | 3 | 4 | 5 | 6 | 1 | 2 |
| High-velocity Four Ball Test Wear-scar Size | mm | 0.52 | 0.45 | 0.51 | 0.50 | 0.31 | 0.57 | 0.48 | 0.53 |
| Falex Test Seizuring Load | lb | 770 | 850 | 940 | 810 | 810 | 850 | 900 | 460 |

TABLE 5

| | | Inventive Examples | | | | | | Comparative |
|---|---|---|---|---|---|---|---|---|
| | | 7 | 8 | 9 | 10 | 11 | 12 | Example 3 |
| High-velocity Four Ball Test Wear-scar Size | mm | 0.55 | 0.48 | 0.87 | 0.54 | 0.5 | 0.52 | 0.48 |
| Falex Test Seizuring Load | lb | 810 | 770 | 810 | 740 | 770 | 800 | 900 |

2) FALEX Test

The seizuring load of each of sample pieces was measured by FALEX test in accordance with ASTM D3233 (A method). However, the test was conducted at room temperature. The results are shown in Tables 4 and 5. The larger the load, the more the oil is excellent in anti-seizuring properties.

3) Valvetrain Wear Test

A valvetrain wear test was conducted in accordance with JASO M328-95 so as to measure the locker arm pad scuff area, and the quantities of wear of the locker arm and cam, respectively. Table 6 shows the results obtained using the lubricating oil compositions of Inventive Examples 12 and 13 and Comparative Example 3.

TABLE 6

| JASO KA24E Valvetrain Wear Test | | Inventive Example 12 | Inventive Example 13 | Comparative Example 3 |
|---|---|---|---|---|
| Locker Arm Pad Scuff Area | % | 2.8 | 2.8 | 2.9 |
| Locker Arm Wear | μm | 2.3 | 2.4 | 2.3 |
| Cam Wear | μm | 2.1 | 2.3 | 2.8 |

As apparent from Tables 4 and 5, the lubricating oil compositions of the present invention were extremely enhanced in anti-seizuring properties evaluated by the FALEX test, compared with the oil composition of Comparative Example 2 which is free of Components (A) and (B). Furthermore, the lubricating oil compositions of the present invention exhibited significantly improved anti-seizuring properties. Particularly such effects are significant when the ratio of Components (A) to (B) is within the range of 0.3 to 2 like the lubricating oil composition of Inventive Example 3. With regard to the anti-wear properties evaluated by the high-velocity four-ball test, the oil composition of Inventive Example 5 containing ZP, ZMTP, and ZDTP was extremely enhanced in anti-wear properties.

As apparent from the results in Table 6, the lubricating oil compositions of Inventive Example 12 and 13 exhibited anti-wear properties which are equivalent to or better than the oil composition of Comparative Example 3. Therefore, the lubricating oil composition of the present invention was found to be excellent in anti-wear properties in the moving valve system in an actual engine.

(6) Fuel Efficiency Evaluated By an Engine-motoring Test

An engine-motoring test was conducted using a 4-valve DOHC engine having a sliding cam/follower contact with a displacement of 1500 cc at oil temperatures of 80° C. and 95° C. and at a rotation speed of 750, 1,000 and 1,500 rpm, respectively. The compositions of Inventive Example 11 and Comparative Example 3 were used and evaluated based on the result of Comparative Example 3. The results are shown in Table 7.

TABLE 7

| Motoring Torque Decreasing Rate | | Inventive Example 11 | Comparative Example 3 |
|---|---|---|---|
| 80° C., 750 rpm | % | 3 | reference |
| 80° C., 1000 rpm | % | 1 | reference |
| 80° C., 1500 rpm | % | 0 | reference |
| 95° C., 750 rpm | % | 8 | reference |
| 95° C., 1000 rpm | % | 6 | reference |
| 95° C., 1500 rpm | % | 1 | reference |

As shown in Table 7, the lubricating oil composition of Inventive Example 11 was found to be excellent in engine torque decreasing rate and particularly in fuel efficiency at an elevated temperature and at a low rotation speed.

INVENTIVE EXAMPLES 14 TO 19 AND COMPARATIVE EXAMPLE 4

The inventive lubricating oil compositions of Inventive Examples 14 to 19 were prepared in accordance of the formulations shown in Table 8. The high-temperature detergency of each of the compositions was evaluated in terms of (1) the change of total base number with the lapse of time in accordance with ISOT and (4) high-temperature detergency evaluated by a hot tube test. The results are shown in Table 8.

TABLE 8

| | | Inventive Examples | | | | | | Comparative |
|---|---|---|---|---|---|---|---|---|
| | | 14 | 15 | 16 | 17 | 18 | 19 | Example 4 |
| Hydrogenatated-refining Mineral Oil[1)] | mass % | residue | residue | residue | residue | residue | residue | residue |
| (A) ZP[2)] | mass % | 0.6 | 0.6 | 0.6 | 0.6 | 0.3 | 0.3 | — |
| Amount in terms of Phosphorus | mass % | (0.08) | (0.08) | (0.08) | (0.08) | (0.04) | (0.04) | — |
| (B) ZDTP[3)] | mass % | — | — | — | — | 0.5 | 0.5 | 1.0 |
| Amount in terms of Phosphorus | mass % | — | — | — | — | (0.04) | (0.04) | (0.08) |
| Amount in terms of Sulfur | mass % | — | — | — | — | (0.08) | (0.08) | (0.16) |
| (C) Ca Salicylate[4)] | mass % | 11.3 | — | — | 2.0 | 11.3 | — | — |
| Amount in terms of Ca | mass % | (0.26) | — | — | (0.04) | (0.26) | — | — |
| (C) Ca Salicylate[5)] | mass % | — | 6.3 | — | — | — | 6.3 | — |
| Amount in terms of Ca | mass % | — | (0.26) | — | — | — | (0.26) | — |
| (C) Ca Salicylate[6)] | mass % | — | — | 4.2 | 3.9 | — | — | 4.2 |
| Amount in terms of Ca | mass % | — | — | (0.26) | (0.24) | — | — | (0.26) |
| (D) Ashless Despersant[7)] | mass % | 5.0 | 5.0 | 5.0 | 5.0 | 5.0 | 5.0 | 5.0 |
| (E) Oxidation Inhibitor[8)] | mass % | 2.0 | 2.0 | 2.0 | 2.0 | 2.0 | 2.0 | 2.0 |
| Other Additives | | | | | | | | |
| Viscosity Index Improver[9)] | mass % | 4.0 | 4.0 | 4.0 | 4.0 | 4.0 | 4.0 | 4.0 |
| Anti-emulsifier[10)] | mass % | 0.01 | 0.01 | 0.01 | 0.01 | 0.01 | 0.01 | 0.01 |
| Total Sulfur Content in Composition | mass % | 0.01 | 0.01 | 0.01 | 0.01 | 0.09 | 0.09 | 0.17 |
| Total Base Number Remaining Rate after ISO Test (150° C.) (HCl method) | | | | | | | | |
| after 48 hours | % | 82 | 76 | 71 | 79 | 56 | 56 | 50 |
| after 125 hours | % | 62 | 56 | 54 | 65 | 28 | 26 | 25 |
| Hot Tube Test (Grade: 10 = Best) | | | | | | | | |
| 290° C. | | 10 | 10 | 10 | 10 | 10 | 10 | 10 |
| 300° C. | | 10 | 10 | 10 | 10 | 10 | 10 | 7 |
| 310° C. | | 10 | 10 | 8 | 10 | 8 | 8 | 0 |
| 320° C. | | 5 | 2 | 0 | 2 | 0 | 0 | 0 |

[1)]aromatic content: 1.2%, sulfur content: 10 mass ppm, kinematic viscosity at 100°: 5.6 $mm^2/s$, viscosity index: 125, NOACK evaporation loss: 8 mass %
[2)]a compound of formula (1) wherein $Y^1$ is zinc, all of $X^1$ to $X^4$ are oxygen, and $R^1$ to $R^4$ are butyl
[3)]a compound of formula (3) wherein $Y^2$ is zinc, and $R^{21}$ to $R^{24}$ are 2-ethylhexyl (phosphorus content: 8.0 mass %, sulfur content: 16.0 mass %)
[4)]Ca content: 2.3 mass %, total base number: 70 mgKOH/g, metal ratio: 1.0,
[5)]Ca content: 4.15 mass %, total base number: 120 mgKOH/g, metal ratio: 1.8
[6)]Ca content: 6.2 mass %, total base number: 170 mgKOH/g, metal ratio: 2.7
[7)]a mixture of polybutenyl succinimide (bis-type, number-average molecular weight of polybutenyl: 1300, nitrogen content: 1.5 mass %) and a boric acid modified product thereof
[8)]octyl-3-(3,5-di-t-butyl4-hydroxyphenyl)propionate and alkyldiphenylamine (1:1)
[9)]OCP average molecular weight: 150,000
[10)]polyalkylene glycol-based As apparent from the results in Table 8, the compositions containing Component (A) and a metal detergent in combination (Inventive Examples 14 to 19) exhibited enhanced base number maintaining properties and excellent high-temperature detergency. Particularly, significantly improved base number maintaining properties and high-temperature detergency can be obtained using an alkaline earth metal salicylate having a total base number of less than 150 mgKoH/g (Inventive Examples 14 and 15) or a combination of an alkaline earth metal salicylate having a total base number of 150 mgKOH/g or more therewith (Inventive Example 17). The compositions containing Components A and B exhibited excellent high-temperature detergency when used in combination with a detergent which is an alkaline earth metal salicylate having a total base number of less than 150 mgKOH/g (Inventive Examples 18 and 19). Whereas, the composition containing no Component (A) but Component (B) (Comparative Example 4) was poor in base number maintaining properties and particularly high-temperature detergency even used together with an alkaline earth metal salicylate having a total base number of less than 150 mgKOH/g.

INVENTIVE EXAMPLES 20 AND 21 AND COMPARATIVE EXAMPLE 5

The inventive lubricating oil compositions of Inventive Examples 20 and 21 and Comparative Example 5 were prepared in accordance with the formulations shown in Table 9. Each of the compositions were subjected to NOx absorbing test so as to evaluate the change of total base number with the lapse of time. The results are shown in Table 9.

TABLE 9

| | | Inventive Examples | | Comparative |
|---|---|---|---|---|
| | | 20 | 25 | Example 5 |
| Hydrogenatated-refining Mineral Oil[1)] | mass % | residue | residue | residue |
| (A) ZP[2)] | mass % | 0.6 | 0.3 | — |
| Amount in terms of Phosphorus | mass % | (0.08) | (0.04) | — |
| (B) ZDTP[3)] | mass % | — | 0.55 | 1.1 |
| Amount in terms of Sulfur | mass % | — | (0.08) | (0.16) |
| (C) Ca Salicylate[4)] | mass % | 2.0 | 2.0 | 2.0 |
| Amount in terms of Ca | mass % | (0.04) | (0.04) | (0.04) |
| (C) Ca Sulfonate[5)] | mass % | 2.0 | 2.0 | 2.0 |
| Amount in terms of Ca | mass % | (0.24) | (0.24) | (0.24) |
| Amount in terms of Sulfur | mass % | (0.03) | (0.03) | (0.03) |
| (D) Ashless Despersant[6)] | mass % | 5.0 | 5.0 | 5.0 |
| (E) Oxidation Inhibitor[7)] | mass % | 2.0 | 2.0 | 2.0 |

TABLE 9-continued

| | | Inventive Examples | | Comparative |
|---|---|---|---|---|
| | | 20 | 25 | Example 5 |
| Other Additives | | | | |
| Viscosity Index Improver[8)] | mass % | 4.0 | 4.0 | 4.0 |
| Anti-emulsifier[9)] | mass % | 0.01 | 0.01 | 0.01 |
| Total Sulfer Content in Composition | mass % | 0.04 | 0.12 | 0.20 |
| Total Base Number Remaining Rate after NOx Absorbing Test (135° C.) (HCI method) | | | | |
| after 10 hours | % | 92 | 83 | 65 |
| after 48 hours | % | 65 | 40 | 17 |

[1)]aromatic content: 1.2%, sulfur content: 10 mass ppm, kinematic viscosity at 100° : 5.6 $mm^2/s$, viscosity index: 125, NOACK evaporation loss: 8 mass %
[2)]a compound of formula (1) wherein $Y^1$ is zinc, all of $X^1$ to $X^4$ are oxygen, and $R^1$ to $R^4$ are butyl phosphorus content: 13.2 mass %)
[3)]a compound of formula (3) wherein $Y^2$ is zinc, and $R^{21}$ to $R^{24}$ are 1,3-dimethylbutyl (phosphorus content: 7.2 mass %, sulfur content: 14.4 mass %)
[4)]Ca content: 2.3 mass %, metal ratio: 1.0, total base number: 70 mgKOH/g
[5)]Ca content: 12.0 mass %, metal ratio: 10.0 , total base number: 300 mgKOB/g, sulfur content: 1.2 mass %
[6)]a mixture of polybutenyl succinimide (bis-type, number-average molecular weight of polybutenyl: 1300, nitrogen content: 1.5 mass %) and a boric acid modified product thereof
[7)]octyl-3-(3,5-di-t-butyl4-hydroxyphenyl)propionate and alkyldiphenylamine (1:1)
[8)]OCP average molecular weight: 150,000
[9)]polyalkylene glycol-based As apparent from the results shown in Table 9, the composition containing Component (A) (ZP) and the combination of an alkaline earth metal salicylate having a total base number of less than 150 mgKOH/g and an alkaline earth metal sulfonate as metal detergent (Inventive Example 20) exhibited significantly excellent base number maintaining properties in the presence of NOx. The composition of Inventive Example 21 further containing Component (B) had extremely excellent properties, compared with the composition of Comparative Example 5 containing no Component (A) but Component (B). It was found that the compositions of Inventive Examples 20 and 21 could suppress the decrease of initial base number in the presence of NOx. Therefore, when the composition of Inventive Example 13 wherein only an alkaline earth metal sulfonate as a detergent was used in combination with an alkaline earth metal salicylate having a total base number of less than 150 mgKOH/g, the initial decrease of base number of Inventive Example 13 as shown in FIG. 6 can be extremely decreased. The composition of Inventive Example 13 used in combination with an alkaline earth metal salicylate having a total base number of less than 150 mgKOH/g exhibits better base number maintaining properties, compared with a case of using an alkaline earth metal salicylate only (for example, compared with Inventive Example 1 similar composition to Inventive Example 11, shown in FIG. 3, the base number remaining rate after 48 hours was about 35%). Therefore, the compositions of Inventive Examples 20 and 21 can be expected to exhibit more excellent base number maintaining properties evaluated by 1 GFE test than the composition of Inventive Example 11 in FIG. 6

INVENTIVE EXAMPLE 22 AND COMPARATIVE EXAMPLES 6

The lubricating oil compositions of Inventive Example 22 and Comparative Example 6 were prepared in accordance with the formulations shown in Table 10. Each of the compositions was subjected to the above-described high-velocity four ball test and FALEX test and a thermal stability test described below so as to evaluate the properties as a hydraulic oil. The results are also shown in Table 10.

Thermal Stability Test

The total increase of acid number of each composition was evaluated in accordance with JIS K 2540 "Testing method for Thermal Stability of Lubricating Oils". That is, 50 ml of a sample oil was taken to a 100 ml beaker. The beaker was then place in a thermostat maintained at a temperature of 140° C. for 24 hours. The increase of total acid number was obtained by comparing the total acid number of a fresh oil with that of the sample oil diluted with n-hexane after the test and filtered through 0.8 $\mu$m membrane filter.

TABLE 10

| | | Inventive Example 22 | Comparative Example 6 |
|---|---|---|---|
| Hydrogenatated-refining Mineral Oil[1)] | mass % | residue | residue |
| (A) ZP[2)] | mass % | 0.5 | — |
| (B) ZDTP[3)] | mass % | — | 0.5 |
| (E) Oxidation Inhibitor[4)] | mass % | 0.2 | 0.2 |
| Other Additives | mass % | 0.1 | 0.1 |
| Kinematic Viscosity (40° C.) | $mm^2/s$ | 45.12 | 45.16 |
| Kinematic Viscosity (100° C.) | $mm^2/s$ | 7.524 | 7.535 |
| Total Acid Number | mgKOH/g | 0.2 | 0.2 |
| Total Base Number (HCI method) | mgKOH/g | 0.03 | 0.05 |
| Element Concentration | | | |
| P | mass % | 0.05 | 0.05 |
| Zn | mass % | 0.06 | 0.06 |
| S | mass % | 0.03 | 0.08 |
| N | mass % | 0 | 0 |
| High-velocity Four Ball Test Wear-scar Size | mm | 0.51 | 0.58 |
| Falex Test Seizuring Load | lb | 900 | 750 |
| Thermal Stability Test Total Acid Number Increase | mgKOH/g | 0.2 | 0.5 |

[1)]hydrogenated-refining mineral oil, kinematic viscosity at 100° C.: 7.5 mm2/s, kinematic viscosity at 40° C.: 45 mm2/s, viscosity index: 130, aromatic content: 1.3 mass percent, sulfur content: 0.03 mass percent
[2)]a compound of formula (1) wherein $Y^1$ is zinc, all of $X^1$ to $X^4$ are oxygen, and $R^1$ to $R^4$ are 2-ethylhexyl
[3)]a compound of formula (3) wherein $Y^2$ is zinc, and $R^{21}$ to $R^{24}$ are 4-methyl-2-pentyl
[4)]2,6-di-tert-butyl-4-butylphenol
[5)]rust inhibitor (glycerin monooleate)

As apparent from the results in Table 10, the composition of Inventive Example 22 exhibited better properties evaluated by the high-velocity four ball test and FALEX test than the composition of Comparative Example 6 which contains no Component (A) and excellent thermal stability. Therefore, the inventive composition was found to have excellent properties as a hydraulic oil.

Therefore, the lubricating oil composition of the present invention which is decreased in ZDTP content or is free of ZDTP can maintain excellent anti-wear properties and has significantly excellent base number maintaining properties. Furthermore, the lubricating oil composition of the present invention exhibits an excellent high-temperature detergency at a temperature exceeding 300° C. and fuel efficiency and thus is a low-sulfur content lubricating oil composition having excellent properties such as long-drain properties and fuel efficiency which oil had not been able to be developed.

What is claimed is:

1. A lubricating oil composition which comprises a lubricating base oil and (A) at least one compound selected from the group consisting of compounds represented by formula (1) below and compounds represented by formula (2) below:

(1)

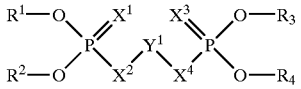

wherein $R^1$, $R^2$, $R^3$ and $R^4$ are each independently hydrogen or a hydrocarbon group having 1 to 30 carbon atoms, $X^1$, $X^2$, $X^3$ and $X^4$ are each independently oxygen or sulfur, but at least one of them is oxygen, and $Y^1$ is a metal atom; and (2)

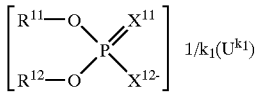

wherein $R^{11}$ and $R^{12}$ are each independently hydrogen or a hydrocarbon group having 1 to 30 carbon atoms, $X^{11}$ and $X^{12}$ are each independently oxygen or sulfur, but at least one of them is oxygen, U is a monovalent metal ion, an ammonium ion or a proton and $k_1$ is an integer of 1 to 20, and wherein the composition is free of zinc dialkyl dithiophosphate.

2. The lubricating oil composition according to claim 1 which further comprises (B) at least one compound selected from the group consisting of compounds represented by formula (3) below and compounds represented by formula (4) below:

(3)

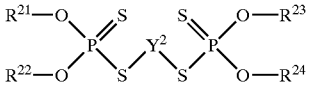

wherein $R^{21}$, $R^{22}$, $R^{23}$ and $R^{24}$ are each independently hydrogen or a hydrocarbon group having 1 to 30 carbon atoms; and $Y^2$ is a metal atom; and (4)

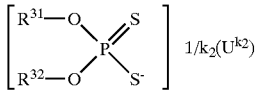

wherein $R^{31}$ and $R^{32}$ are each independently hydrogen or a hydrocarbon group having 1 to 30 carbon atoms, U is a monovalent metal ion, an ammonium ion, or a proton and $k_2$ is an integer from 1 to 20, and wherein a mass ratio of (B)/(A) is 1.5 or less.

3. The lubricating oil composition according to claim 2 wherein $Y^1$ in said formula (1) and $Y^2$ in said formula (3) are each independently zinc or calcium.

4. The lubricating oil composition according to claim 1 which further comprises at least one additive selected from the group consisting of (C) metal detergents, (D) ashless dispersants, and (E) oxidation inhibitors.

5. The lubricating oil composition according to claim 4 wherein said (C) metal detergents are at least one selected from the group consisting of alkali metal or alkaline earth metal salicylates and alkali metal or alkaline earth metal sulfonates.

6. The lubricating oil composition according to claim 5 wherein the total base number of said alkali metal or alkaline earth metal salicylates is 150 to 400 mgKOH/g.

7. The lubricating oil composition according to claim 5 wherein the total base number of said alkali metal or alkaline earth metal salicylates is less than 150 mgKOH/g.

8. The lubricating oil composition according to claim 5 wherein the total base number of said alkali metal or alkaline earth metal salicylates is less than 100 mgKOH/g.

9. The lubricating oil composition according to claim 5 wherein said (C) metal detergent is a mixture of an alkali metal or alkaline earth metal salicylate having a total base number of less than 150 mgKOH/g and an alkali metal or alkaline earth metal salicylate having a total base number of 150 to 400 mgKOH/g.

10. The lubricating oil composition according to claim 5 wherein said (C) metal detergent is a mixture of an alkali metal or alkaline earth metal salicylate having a total base number of less than 150 mgKOH/g and an alkali metal or alkaline earth metal sulfonate.

11. The lubricating oil composition according to claim 1 which is used for an internal combustion engine.

12. The lubricating oil composition according to claim 1 which is used for an internal combustion engine using low-sulfonated fuel of 50 mass ppm or less.

13. The lubricating oil composition according to claim 1 which is used for a gas engine.

14. The lubricating oil composition according to claim 1 wherein the sulfur content is 0.005 percent by mass.

15. The lubricating oil composition according to claim 1 wherein the sulfur content is 0.3 percent by mass.

16. A lubricating oil composition which comprises a lubricating base oil and (A) at least one compound selected from the group consisting of compounds represented by formula (1) below:

(1)

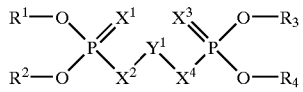

wherein $R^1$, $R^2$, $R^3$ and $R^4$ are each independently hydrogen or a hydrocarbon group having 1 to 30 carbon atoms, $X^1$, $X^2$, $X^3$ and $X^4$ are each independently oxygen or sulfur, but at least one of them is oxygen, and $Y^1$ is a metal atom, and wherein the composition is free of zinc dialkyl dithiophosphate.

17. The lubricating oil composition according to claim 16 which further comprises (B) at least one compound selected from the group consisting of compounds represented by formula (3) below:

(3)

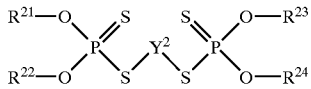

wherein $R^{21}$, $R^{22}$, $R^{23}$ and $R^{24}$ are each independently hydrogen or a hydrocarbon group having 1 to 30 carbon atoms, $X^2$ is a metal atom, and wherein a mass ratio of (B)/(A) is 1.5 or less.

18. The lubricating oil composition according to claim 16 wherein $R^1$, $R^2$, $X^1$, $X^2$, $X^3$ and $X^4$ are each oxygen and $Y^1$ is selected from the group consisting of zinc, copper, iron, lead, nickel, silver, and manganese.

* * * * *